US010072431B2

(12) United States Patent
Hall

(10) Patent No.: US 10,072,431 B2
(45) Date of Patent: Sep. 11, 2018

(54) EXERCISE POOL WITH CIRCULATING FLOW

(71) Applicant: David E. Hall, Moline, IL (US)

(72) Inventor: David E. Hall, Moline, IL (US)

( * ) Notice: Subject to any disclaimer, the term of this patent is extended or adjusted under 35 U.S.C. 154(b) by 0 days.

(21) Appl. No.: 15/688,855

(22) Filed: Aug. 28, 2017

(65) Prior Publication Data

US 2018/0044934 A1 Feb. 15, 2018

Related U.S. Application Data

(63) Continuation-in-part of application No. 14/064,968, filed on Oct. 28, 2013, which is a continuation of application No. 13/163,990, filed on Jun. 20, 2011, now Pat. No. 8,607,372, which is a continuation of application No. 11/986,572, filed on Nov. 23, 2007, now Pat. No. 7,984,519.

(60) Provisional application No. 62/380,124, filed on Aug. 26, 2016, provisional application No. 60/860,641, filed on Nov. 22, 2006.

(51) Int. Cl.
*E04H 4/00* (2006.01)

(52) U.S. Cl.
CPC ..... *E04H 4/005* (2013.01)

(58) Field of Classification Search
CPC ..... E04H 4/005; E04H 4/0043; E04H 4/1245
USPC ..... 4/506, 507, 509
See application file for complete search history.

(56) References Cited

U.S. PATENT DOCUMENTS

| | | | |
|---|---|---|---|
| 722,232 | A | 3/1903 | Hoeglauer |
| 1,536,875 | A | 5/1925 | Bowen |
| 1,630,797 | A | 5/1927 | James |
| 1,731,554 | A | 10/1929 | Wheeler |
| 1,786,613 | A | 12/1930 | Hooper |
| 2,035,835 | A | 3/1936 | Heinrich |
| 3,222,036 | A | 12/1965 | Franz et al. |
| 3,444,659 | A | 5/1969 | Shanni |
| 3,820,174 | A | 6/1974 | Rozanski |
| 4,060,946 | A | 12/1977 | Lang et al. |

(Continued)

FOREIGN PATENT DOCUMENTS

| | | |
|---|---|---|
| DE | 2222594 A1 | 11/1973 |
| EP | 0313242 A2 | 4/1989 |

(Continued)

OTHER PUBLICATIONS

ISA/RU, PCT/US2017/048972, International Search Report and Opinion, dated Dec. 28, 2017.

*Primary Examiner* — Huyen Le

(74) *Attorney, Agent, or Firm* — Hamilton IP Law, PC; Jay R. Hamilton; Charles Damschen

(57) ABSTRACT

A Exercise Pool is disclosed herein having a rigid frame modular in design to allow for improved delivery and assembling. As shown the system may be configured with a box like structure providing containment of the flow head and may be configured with a removable walk deck having an air gap built in. As disclosed the treadmill swimming pool system as its general configuration is safer for users as it inhibits and/or eliminates hair and body entrapment. As disclosed it has a balanced flow which better replicates or reproduces actual swimming conditions for an enhanced user experience. The propulsion system may be controlled with a variable frequency drive (VFD) to allow for improved swimming conditions and control of same.

28 Claims, 36 Drawing Sheets

(56) References Cited

U.S. PATENT DOCUMENTS 4,124,907 A * 11/1978 Laven ..... E04H 4/0043 4/488
4,177,614 A * 12/1979 Arp ..... E04H 4/0043 4/506
4,290,153 A 9/1981 Kockerols et al.
4,352,215 A 10/1982 Laing
4,464,802 A 8/1984 Glonek et al.
4,907,304 A 3/1990 Davidson et al.
4,938,469 A 7/1990 Crandell
5,044,021 A 9/1991 Murdock
5,207,729 A 5/1993 Hatanaka
5,298,003 A 3/1994 Weihe et al.
5,438,712 A 8/1995 Hubenthal
5,662,558 A 9/1997 Shannon
5,787,519 A 8/1998 Smith
5,794,280 A 8/1998 Hansen et al.
6,030,180 A 2/2000 Clarey et al.
6,233,754 B1 * 5/2001 Ajima ..... A63B 69/125 4/488
6,789,278 B2 9/2004 Shea
7,412,802 B2 * 8/2008 Kantor ..... E04H 4/0043 249/DIG. 3
7,984,519 B1 7/2011 Hall
8,607,372 B2 * 12/2013 Hall ..... E04H 4/005 4/507
8,739,322 B2 * 6/2014 Hof ..... A63B 69/125 4/488
9,038,208 B2 5/2015 Ferriss et al.
9,428,928 B2 8/2016 Ferriss et al.
9,938,739 B2 * 4/2018 Hall ..... E04H 4/0043 4/506
2004/0143894 A1 7/2004 Shea
2006/0045750 A1 3/2006 Stiles
2006/0112480 A1 * 6/2006 Sisk ..... E04H 4/12 4/507
2006/0260036 A1 * 11/2006 Stover ..... E04H 4/129 4/507
2007/0266490 A1 11/2007 Foy
2008/0148470 A1 6/2008 Ferriss et al.
2011/0239361 A1 10/2011 Hall
2013/0067654 A1 * 3/2013 Deloche ..... E04H 4/1209 4/507
2016/0237708 A1 8/2016 Ferriss et al.
2017/0204628 A1 7/2017 Livingston

FOREIGN PATENT DOCUMENTS

EP 0472976 A2 3/1992
GB 2296861 A 7/1996
RU 2304205 C1 8/2007

* cited by examiner

73

EXERCISE POOL WITH CIRCULATING FLOW

CROSS REFERENCE TO RELATED APPLICATIONS

Applicant states that this utility patent application is a continuation-in-part of U.S. patent application Ser. No. 14/064,968 filed on Oct. 28, 2013 which was a continuation of U.S. patent application Ser. No. 13/163,990 filed on Jun. 20, 2011 (now U.S. Pat. No. 8,607,372), which was a continuation of and claimed priority from U.S. patent application Ser. No. 11/986,572 filed on Nov. 23, 2007 (now U.S. Pat. No. 7,984,519), which claimed priority under 35 U.S.C. § 119(e) of provisional U.S. Pat. Application Ser. No. 60/860,641 filed on Nov. 22, 2006, all of which are incorporated by reference herein in their entireties. Applicant also claims priority under 35 U.S.C. § 119(e) of provisional U.S. Pat. Application Ser. No. 62/380,124 filed on Aug. 26, 2016, which is incorporated by reference herein in its entirety.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable

AUTHORIZATION PURSUANT TO 37 C.F.R. § 1.171

A portion of the disclosure of this patent document contains material which is subject to copyright and trademark protection. The copyright owner has no objection to the facsimile reproduction by anyone of the patent document or the patent disclosure, as it appears in the Patent and Trademark Office patent file or records, but otherwise reserves all copyrights whatsoever.

FIELD OF THE INVENTION

Swimming pools and more particularly, self-contained exercise swimming pools that can generate currents of various speeds for exercise, therapy and rehabilitation. The present invention relates to an improved exercise pool which may be deployed through a novel structure within any pool structure including as a stand-alone flow head, a drop-in unit propulsion unit which may be positioned in the end of an existing swimming pool to produce a circulating flow, with or without water returns, or built as stand-alone self-contained exercise pool containing a circulating water stream or flow.

BACKGROUND OF PRIOR ART

Continuous swimming tanks are known generally. German Patent No. 2,222,594 issued to Hoppe shows a continuous swimming tank. In the tank described therein, water circulates from the front of a swimming area past the swimmer to the rear of the swimming area where it is recirculated through a duct which runs beneath the floor of the swimming area. One set of turning vanes directs the water from the swimming area to the recirculation duct. The water passes over a propeller located in the duct and used for circulation. The second set of turning vanes directs the water from the recirculation duct back into the front of the swimming area.

The swimming area shown in the German '594 patent widens from the front of the tank to the rear of the tank. That is, the cross-sectional area of the swimming area increases from the front to the rear of the tank. This results in velocity variations over the length of the tank. The velocity of the flowing water is greater at the front of the swimming area than it is at the rear of the swimming area. Thus, a swimmer may choose where to swim, according to water velocity. The flow rate of water is constant anywhere in a given cross-section, perpendicular to the direction of water flow. The preceding prior art is incorporated by reference herein.

The problem with such a design is that it requires a large swimming area and thus a large swimming tank. Further, a large motor and great deal of power is required to circulate such a large volume of water.

U.S. Pat. No. 2,035,835 issued to Raber for "Swimming Bath" shows a continuous swimming tank. In this reference, water is circulated either beneath the floor of the swimming area or around the sides of the swimming area. No turning vanes are used to direct the water. The problem with such a tank is that large amounts of turbulence are developed, and loss of water velocity results. Therefore, more power is needed to circulate the water, and swimming comfort is adversely affected by the turbulence. The preceding prior art is incorporated by reference herein.

U.S. Pat. No. 5,044,021 issued to James Murdock for a "Continuous swimming apparatus" discloses and claims a swim treadmill which is said to avoid the power and size shortcomings of the prior art by providing a compact swimming apparatus. The apparatus consists essentially of a tank adapted to contain water and having a swimming area within the tank. Water flows through the swimming area from a water entrance end to a water exit end and returns to the water entrance end via a return path positioned adjacent the swim area. Water circulation means is included in the return path for propelling the water through the return path and through the swimming area. A plurality of vanes are located in the return path to direct the water from the return path to the entrance end of the swimming area and from the exit end of the swimming area to the return path. The vanes help to minimize power losses by minimizing water turbulence. The vanes are spaced in such a way as to create a horizontal velocity gradient across the swimming area whereby water closer to the center of the swimming area has a higher velocity than water near the sides of the swimming area. The preceding prior art is incorporated by reference herein.

UK Patent GB 2,296,861, issued to Spaform Limited, Jul. 8, 1998, teaches arranging circulating passages to communicate with the delivery passages externally of the tank portion, and by mounting the (single) propeller means in the delivery passage, the propeller means can be mounted externally of the tank portion to facilitate servicing. Water is circulated in the tank portion so that a swimmer can swim against the first flow generated by water being propelled into the tank portion through the delivery passage by the (single) propeller means. Water is circulated back in the tank portion on either side of the main first flow and in counterflow thereto. Thus space is not wasted by arranging ducting externally of the tank portion for returning water from one end or side of the tank portion. The water in the tank portion is preferably intended to be circulated at or just below the water surface in a generally horizontal plane. As shown, the bottom of the exercise pool has a sloped bottom to further facilitate return of the circulating water flow. The preceding prior art is incorporated by reference herein.

U.S. Pat. Nos. 9,038,208 and 9,428,928 as well as published US Pat. Appl. No. 20160237708 (hereinafter "Ferriss et al.") also teach and disclose a single propeller or propeller means within a swimming pool to produce a circulating water flow, in which a single plenum arrangement is used to create circuitous water flow paths within the swimming compartment of the swimming pool. As disclosed the method of operating a swimming pool with a circulating water flow includes the steps of discharging a jet of water and splitting the flow of water. The discharging step including the discharging of a jet of water from an outlet at a head end of the swimming pool into a swimming compartment, whereby the jet of water flows in a primary flow path toward a foot end of the swimming compartment. The splitting step including the splitting of the flow of water to define two circuitous flow paths, each said flow path having a return flow path flowing within said swimming compartment in a direction generally opposite to said primary flow path back toward said head end. The foot end of Ferriss as shown in FIG. 1 is seating for a spa or hot tub, inherently providing curved surfaces which appear to assist with current flow diversion and re-direction back to the head end. The preceding prior art is incorporated by reference herein.

Published US Patent application 20170204628 entitled "Swim Spa" listing Livingston, Jr. as an inventor teaches a forward current created by pumping equipment which directs the forward current from the head end of the tank, past a swimmer in the water to a foot end of the tank, allowing the swimmer to swim in place. A diverter having a curved surface is positioned at the foot end of the tank for redirecting the forward current toward the sidewalls and then back to the head end for recirculation. As taught by Livingston, the diverter may only apply curved surfaces for turning the forward current. Additional prior art of interest include U.S. Pat. No. 1,731,554 issued to M. I. Wheeler for "Swimming Pool" and U.S. Pat. No. 722,232 issued to Hoeglauer for "Bathtub". The preceding prior art is incorporated by reference herein.

SUMMARY OF THE DISCLOSURE: FIGS. 1-16

Referring now to the drawings, FIG. 1 is a simplified perspective view of the major components comprising the self-contained exercise pool disclosed and claimed herein. As shown, the pool is comprised of an externally positioned power system used to drive a hydraulic system which is connected by hydraulic hoses to and drives a water propulsion system. See FIG. 1. The quality of the water used is maintained by the water quality system which continually processes a slipstream of the water contained within the self-contained swimming pool. See FIG. 1.

The propulsion system is mounted at a first end of the self-contained swimming pool for containment of water and generation of water current flows. The water current flows delivered from the first end to the second end of the pool for exercise, therapy and or rehabilitation of a user. During operation, the user typically faces the propulsion unit. The self-contained exercise pool is sized so that during operation a user may swim or exercise against the current generated by the propulsion system. The inner water containment area is created by a rigid frame around the outer perimeter therein. A set of water return channels within intake ports at the second end of the pool allow the return of the water current flows back to the propulsion system. To maximize user functionality, a seating surface has been placed upon the water return channels to allow for user seating on either side of the water current flows.

As illustrated in FIGS. 1, 4 and 7, the self-contained exercise pool disclosed and claimed herein may be adapted for various types and sizes of top decorative surfaces including an eight (8") inch walk-way as shown at FIGS. 2-4 and a two-foot (2') walkway as shown at FIGS. 7-9. As required by local regulations, the self-contained exercise pool as described herein may be adapted for grounding through installation of grounding straps along the bottom portion of the tension straps.

FIGS. 4-6 illustrate the steel supports of the self-contained exercise pool disclosed and claimed herein. FIG. 10 illustrates the tension straps of the self-contained exercise pool disclosed and claimed herein. The combination of the modular steel supports shown at FIG. 4 or FIG. 9 and the tension straps of FIG. 10 produce an interlocking frame structure of sufficient rigidity during operation that tile may be used as the top decorative surface. (See FIG. 11) The choice of tile for the top decorative surface improves the overall aesthetic of the self-contained exercise pool increasing user desirability.

The hydraulic pumping system is exteriorly mounted and also self-contained. The hydraulic pumping system has an electrically driven pump to circulate the glycol based pumping solution through hydraulic hoses connected to the propulsion system. The glycol solution chosen is non-toxic to humans and animals. Although the system as designed to minimize the potential for glycol to enter the water of the pool, however, if the glycol material does enter the water within the inner containment area, it is easily separated from the water through the filtration system of the pool. See FIG. 1. Because electrical pumping systems as well as hydraulic systems are well known in the art, further discussion is unnecessary as related to the present art.

It is well known in the prior art to use vegetable oil as the hydraulic fluid to drive the propulsion system. The problem with using vegetable oil as the hydraulic fluid is that if it introduced into the pool at any time, such as through leakage or spillage, the vegetable oil is immiscible with the water forming a separate layer. The vegetable oil forms a coating or film upon the inner layer of the pool. Furthermore, the filtration system of the prior art is not equipped to remove the vegetable oil from the water. Typically, the operator must remove the contents of the pool and thoroughly wash the unit which requires almost complete disassembly of the pool unit and its component parts so they may be washed down with soap and water prior to re-assembly.

The glycol based pumping solution of the present embodiment is designed for low maintenance and long use. Typically, viscosity breakdown of the glycol solution is of major concern to the prior art. The present system addresses this problem by maintaining a relatively constant temperature of the pumping solution by using a heat exchanger positioned in the inner water circulation area to allow transfer of any excess heat built up in the pumping solution to be transferred to the circulated water. (Not shown) This innovation solves the viscosity breakdown problem. The glycol solution, should it be mixed into the water, through leakage or spillage, is easily removed the existing filtration system. Minor hydraulic fluid leaks of the glycol water solution are hardly noticed by the user. Major glycol leaks into the water of the pool typically present a cloudy appearance which is easily corrected by draining the pool, fixing the leak and refilling the pool with water. No disassembly of the pool or its major components is necessary.

It is therefore an objective of the present disclosure to create a self-enclosed swimming pool with a circulating water flow for use as a water treadmill for use in exercise or rehabilitation.

It is another objective of the present disclosure for the self-enclosed swimming pool to be self-supporting.

It is another objective of the present disclosure for the rigid frame of the self-enclosed swimming pool to be modular in design to allow for improved delivery and assembling.

It is also an objective of the present disclosure for the self-enclosed swimming pool to drive the propulsion system with a hydraulic system with a solution which is non-toxic to both humans and pets.

It is another objective of the present disclosure to provide a treadmill swimming pool system configured to allow for a removable walk deck.

BRIEF DESCRIPTION OF THE FIGS. 1-16

FIG. 1 is a simplified perspective view of the major components comprising the self-contained exercise pool disclosed and claimed herein.

FIG. 2 is a first embodiment of the self-contained exercise pool disclosed and claimed herein adapted for an eight (8") inch walk-way.

FIG. 3 is a deconstructed view of the embodiment of the self-contained exercise pool shown in FIG. 2 having an eight (8") inch walk-way.

FIG. 4 is a deck and wall support for an eight (8") inch walk-way as shown in FIGS. 2-3.

FIG. 5 illustrates the upper area of attachment of adjacent deck and wall supports as shown in FIG. 4.

FIG. 6 illustrates the lower area of attachment of adjacent deck and wall supports as shown in FIG. 4.

FIG. 7 is another embodiment of the self-contained exercise pool disclosed and claimed herein adapted for a twenty-four (24") inch walk-way.

FIG. 8 is a deconstructed view of the embodiment of the self-contained exercise pool shown in FIG. 7 having a twenty-four (24") walk-way.

FIG. 9 illustrates a deck and wall support for a twenty-four (24") walk-way as shown in FIGS. 7-8.

FIG. 10 illustrates a tension strap wall mount.

FIG. 11 illustrates a tension strap wall mount attached to the lower portion of a deck and wall support.

FIG. 12 illustrates the wall seam connecting plate fastened between adjacent deck and wall supports.

FIG. 13 illustrates a corner liner plate.

FIG. 14 illustrates the water return channels for one embodiment as shown in FIGS. 1-13.

FIG. 15 illustrates the suction section of the water return channels shown in FIG. 14.

FIG. 16 illustrates an exploded view of the water return channels for one embodiment as shown in FIGS. 1-15.

DETAILED DESCRIPTION—LISTING OF ELEMENTS FIGS. 1-16

| ELEMENT DESCRIPTION | ELEMENT # |
|---|---|
| Rigid Frame | 1 |
| Inner Water Containment Area | 2 |
| Water Return Channel | 3 |
| Propulsion System | 4 |

-continued

| ELEMENT DESCRIPTION | ELEMENT # |
|---|---|
| Hydraulic System | 5 |
| Hydraulic Fluid | 6 |
| Coping | 7 |
| Decorative Horizontal Surface | 8 |
| Modular Interlocking Panels | 9 |
| Tension Straps | 10 |
| PVC Piping | 11 |
| Intentionally Blank | 12 |
| Mounting Strap | 13 |
| Housing | 14 |
| Intentionally Blank | 15 |
| Power System | 16 |
| Wall Support Covers | 17 |
| Hydraulic Line(s) | 18 |
| Propulsion System Housing | 19 |
| Self-contained Swimming Pool | 20 |
| Water Quality System | 21 |
| Drain | 22 |
| Underwater Benches | 23 |
| Horizontal Wall Supports | 24 |
| Current | 25 |
| Pool Panels (walls) | 27 |
| Pool Panel (interior side) | 28 |
| Pool Panel (exterior side) | 29 |
| Plain Walkway (8") | 30 |
| Walkway (2') | 31 |
| 90 Degree Corner Supports | 32 |
| Top Corner Piece | 33 |
| Adjustable Screw Plate | 34 |
| Wall Seam Connecting Plate | 35 |
| Wall & Deck Support | 36 |
| Suction Tunnel | 37 |
| Seam Joint | 38 |
| Corner Tunnel | 39 |
| Water Return Inlet | 40 |
| Water Return Screen | 41 |
| Top Seat Pie Stiffener | 42 |
| Locking Slot | 43 |
| Bottom Wall Plate | 44 |
| $1^{st}$ Side | 45 |
| $2^{nd}$ Side | 46 |
| $3^{rd}$ Side | 47 |
| $4^{th}$ Side | 48 |
| Water Line | 49 |
| Fastener | 50 |

SUMMARY OF THE DISCLOSURE: FIGS. 17-29

As shown, the pool is comprised of an externally positioned power system used to drive a hydraulic system which is connected by hydraulic hoses to and drives a water propulsion system. The quality of the water used is maintained by the water quality system which continually processes a slipstream of the water contained within the self-contained swimming pool.

In one embodiment of modular wall structure shown in FIGS. 1-16 which may be implemented with the drop-in self-contained propulsion unit disclosed and discussed herein as illustrated throughout without a set of drop-in flow (water return) tunnels, without restriction or limitation.

The exercise pool is configured to discharge circulating water flow from the self-contained drop-in propulsion unit wherein the circulating water flow forms a pair of circuitous water flow paths in the exercise pool, a first water flow path flowing from the head end to the foot end of the exercise pool, the first water flow path useful for swimming, and a second water flow path from the foot end to the head end of the exercise pool for recirculation.

The exercise pool with a circulating water flow as shown and discussed herein is similar to the pool shown in FIGS. 1-16, in that it is also configured to have a first sidewall, a second sidewall, a third sidewall and a fourth sidewall, each sidewall generally non-curved and forming four corners. The corners forming a head end and foot end of the exercise pool.

As shown and discussed herein the exercise pool floor is positioned below, enclosed by and connected to the bottom of the sidewalls and the exercise pool floor is generally non-sloped. As disclosed and discussed, the pool floor may be constructed from multiple layers.

As shown herein a self-contained drop-in propulsion may be positioned on the exercise pool floor between the first and second corners of the exercise pool, the head end for circulating water discharge. In one embodiment the self-contained drop-in propulsion unit may be configured with a plenum arrangement including a common outlet and a plurality of water inlets in relation to the air gap and water level during operation.

As described and disclosed pair of propellers sitting in the horizontal plane work together to generate a vertical water flow for delivery into a set of curved vanes which act upon the water flow for a horizontal discharge. The horizontal water flows transmitted from the plenum arrangement of the self-contained drop-in propulsion unit into the swim area of the exercise pool. The propellers are left hand and right hand and timed to work together, rotating towards each other, to generate a symmetric flow for an enhanced user experience and return flow without return channels along the sides of the pool sidewalls or flow diversion devices located at the foot end of the exercise pool via a common outlet and a plurality of inlets, located exclusively at head end. In one embodiment the self-contained propulsion unit and plenum arrangement are configured with an one air slot(s) positioned above both the common outlet and the plurality of water inlets to limit the height (level) of the circulating water present in the interior of the self-contained drop-in propulsion unit and maintain an air gap above the circulating water flow for improved performance of the propulsion system.

In at least one embodiment of the Exercise Pool in it may be configured to fit in any location because of its modular nature allowing for ease of transport and construction onsite.

In at least one embodiment of the Exercise Pool it may provide a treadmill swimming pool system which is safer for users by inhibiting and/or eliminating hair and body entrapment.

In at least one embodiment of the Exercise Pool it may provide a treadmill swimming pool system having a balanced flow which better replicates or reproduces actual swimming conditions for an enhanced user experience.

In at least one embodiment of the Exercise Pool it may incorporate a propulsion system which is controlled with a variable frequency drive (VFD) to allow for improved swimming conditions and control of same.

DETAILED DESCRIPTION—LISTING OF ELEMENTS FIGS. 17-29

| ELEMENT DESCRIPTION | ELEMENT # |
|---|---|
| Rigid frame | 1 |
| Inner water containment area | 2 |
| Water return channel | 3 |
| Propulsion system | 4 |
| Hydraulic system | 5 |
| Hydraulic fluid | 6 |
| Current | 7 |
| Decorative horizontal surface | 8 |

-continued

| ELEMENT DESCRIPTION | ELEMENT # |
|---|---|
| Modular interlocking panels | 9 |
| Tension straps | 10 |
| PVC piping | 11 |
| Intentionally Blank | 12 |
| Mounting strap | 13 |
| Housing | 14 |
| Intentionally Blank | 15 |
| Power system | 16 |
| Wall support covers | 17 |
| Hydraulic line(s) | 18 |
| Propulsion System housing | 19 |
| Self-contained swimming pool | 20 |
| Water quality system | 21 |
| Drain | 22 |
| Underwater benches | 23 |
| Horizontal wall supports | 24 |
| Current | 25 |
| Pool panels (walls) | 27 |
| Pool panel (interior side) | 28 |
| Pool panel (exterior side) | 29 |
| Plain walkway (8") | 30 |
| walkway (2') | 31 |
| 90 degree corner supports | 32 |
| Top corner piece | 33 |
| Adjustable screw plate | 34 |
| Wall seam connecting plate | 35 |
| Wall & deck support | 36 |
| Suction tunnel | 37 |
| Seam joint | 38 |
| Corner tunnel | 39 |
| Water return inlet | 40 |
| Water return screen | 41 |
| Top seat pie stiffener | 42 |
| Locking slot | 43 |
| Bottom wall plate | 44 |
| $1^{st}$ sidewall | 45 |
| $2^{nd}$ sidewall | 46 |
| $3^{rd}$ sidewall | 47 |
| $4^{th}$ sidewall | 48 |
| Water line | 49 |
| Fastener | 50 |
| First corner | 51 |
| Second corner | 52 |
| Third corner | 53 |
| Fourth corner | 54 |
| Forty-five degree corner filler | 55 |
| Exterior perimeter of 1-4 sidewalls | 56 |
| Interior perimeter of 1-4 sidewalls | 57 |
| Area - exterior perimeter of 1-4 sidewalls | 58 |
| Area - interior perimeter of 1-4 sidewalls | 59 |
| Exercise pool | 60 |
| Head end | 60a |
| Foot end | 60b |
| Wall Gap | 61 |
| Water Stop | 62 |
| Concrete Channel | 63 |
| Wall Stiffener | 64 |
| Top Seat | 65 |
| Corner cap | 66 |
| Coping | 67 |
| Skimmer | 68 |
| | 69 |
| Self-contained drop-in propulsion unit | 70 |
| Front side | 71 |
| Back side | 72 |
| Top side (removable lid configurable as lid) | 73 |
| Bottom side | 74 |
| Left end | 75 |
| Right end | 76 |
| Interior | 77 |
| | 78 |
| | 79 |
| Plenum arrangement | 80 |
| Water inlet(s) | 81 |

-continued

| ELEMENT DESCRIPTION | ELEMENT # |
|---|---|
| Common outlet (discharge) | 82 |
| Equalization wall | 83 |
| Propeller housing | 84 |
| Propeller shroud | 84a |
| Propeller plate (horizontal plane) | 84b |
| Propellers (pair) | 87 |
| Left | 87a |
| Right | 87b |
| Propeller shaft | 88 |
| Hydraulic drive motor | 89 |
| Curved vanes (set) | 90 |
| Air slot | 91 |
| Grating | 92 |
| Speed indicator | 93 |
| Pumping unit control | 94 |
| Speed Indicator | 95 |
| Remote | 96 |
| Hydraulic manifold - propeller drive | 97a |
| Hydraulic manifold - cooler | 97b |
| Air gap | 98 |
| Water level | 99 |
| Circuitous water flow paths (pair) | 100 |
| Water flow path (head to foot) | 100a |
| Water flow path (foot to head) | 100b |
| | 101 |
| Inner water containment area | 102 |
| | 103 |
| Pool floor | 110 |
| Existing floor | 111 |
| Self-level concrete (first layer) | 112 |
| Second layer | 113 |
| PVC (rigid) | 114 |
| PVC (rigid) outer area | 114a |
| PVC (rigid) outer perimeter | 114b |
| Insulation (pink board) | 115 |
| Insulation (pink board) inner area | 115a |
| Third layer - vinyl liner | 116 |
| Compression strip | 117 |
| Compression cover | 117a |
| Fastener (floor) | 119 |

BRIEF DESCRIPTION OF THE DRAWINGS

The accompanying drawings, which are incorporated in and constitute a part of this specification, illustrate embodiments and together with the description, serve to explain and illustrate the principles of the Exercise Pool as disclosed herein.

DETAILED DESCRIPTION

Figure 1:
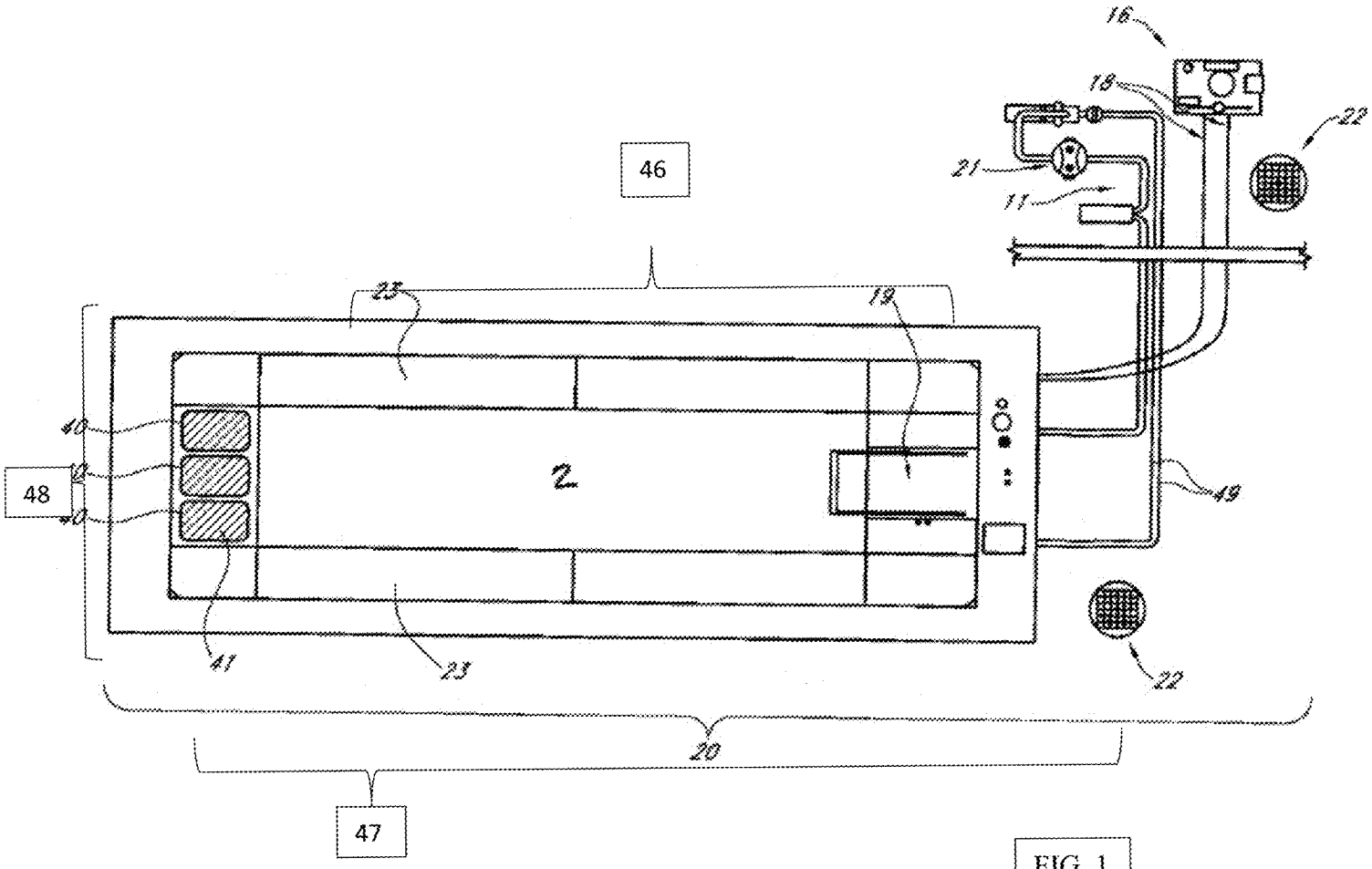
Figure 2:
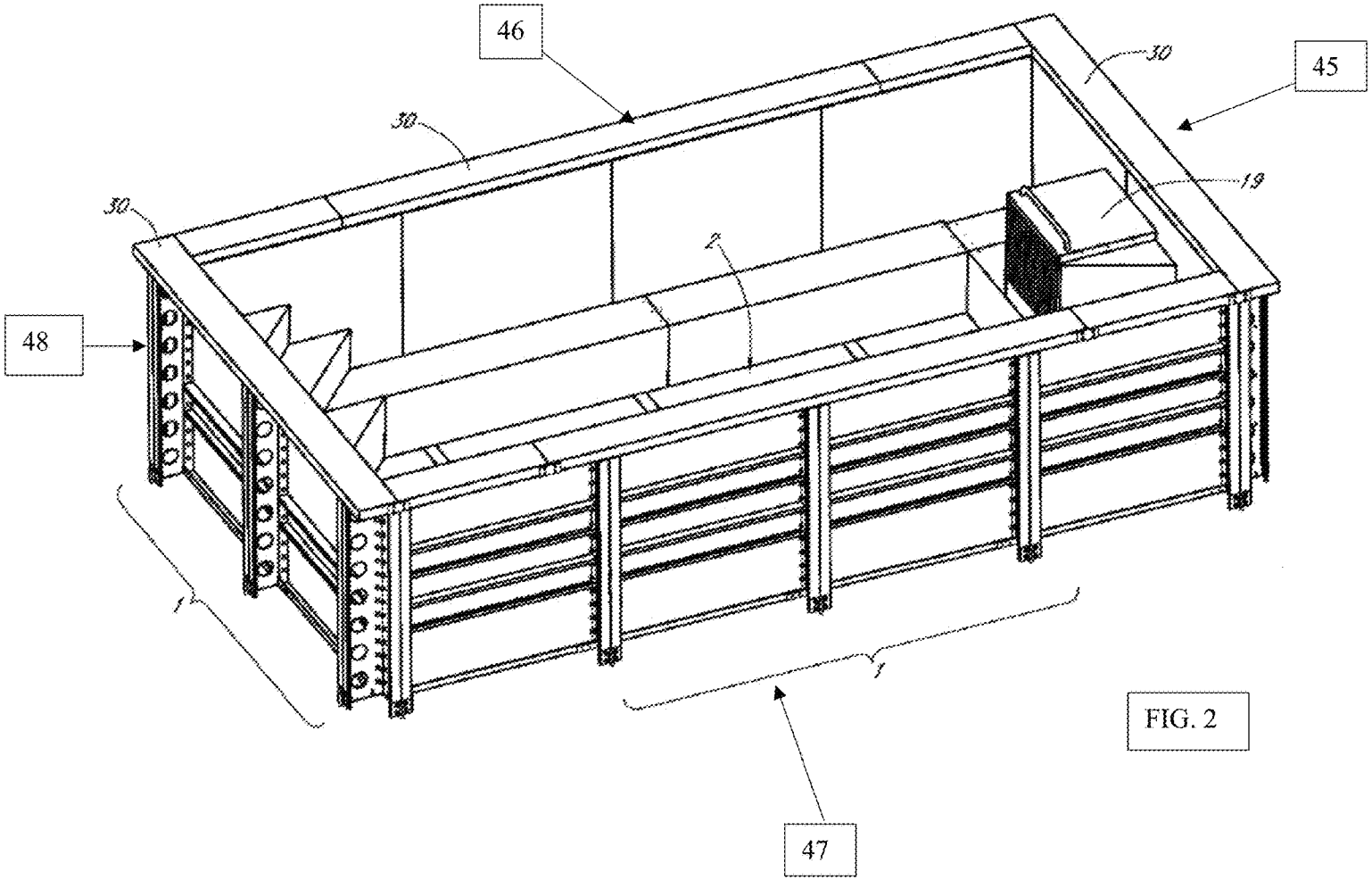
Figure 3:
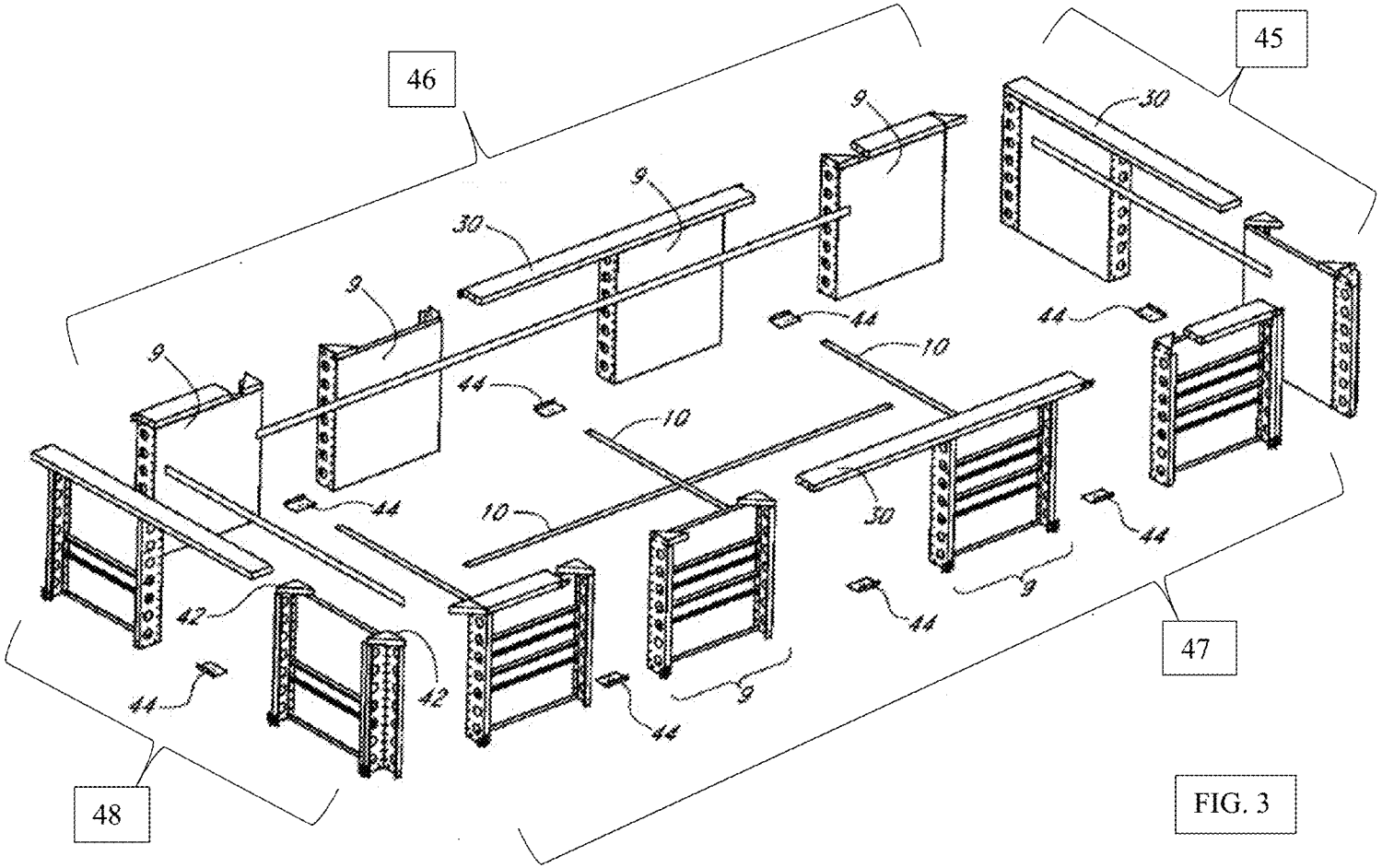
Figure 4:
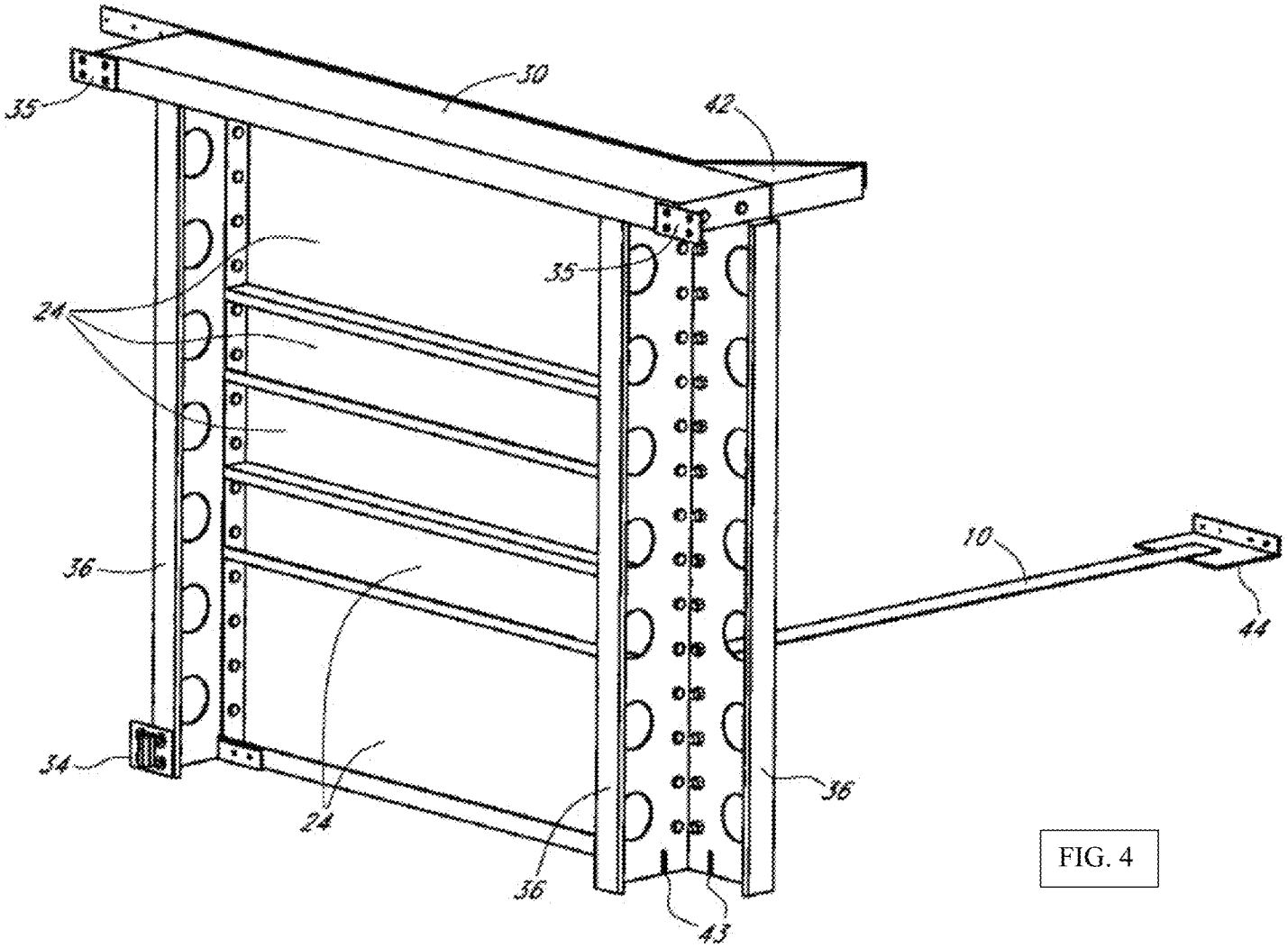
Figure 5:
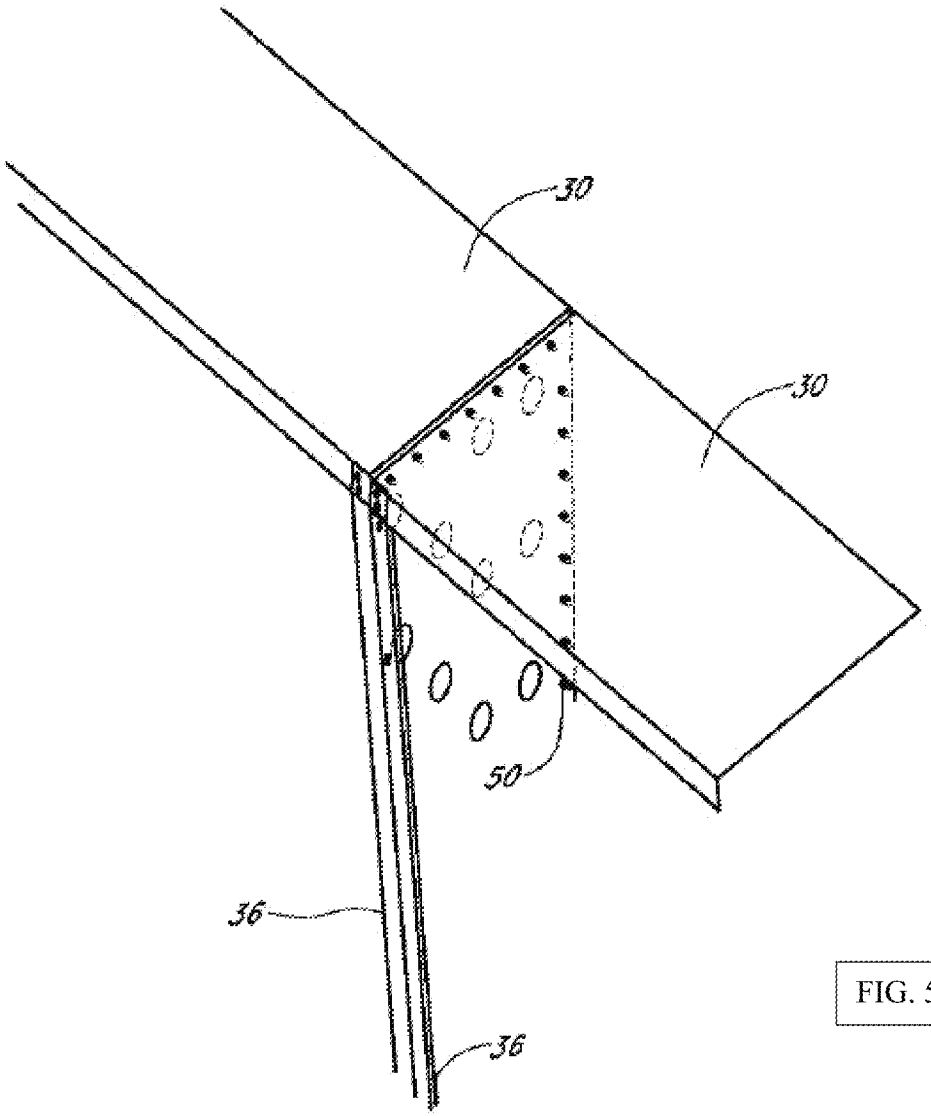
Figure 6:
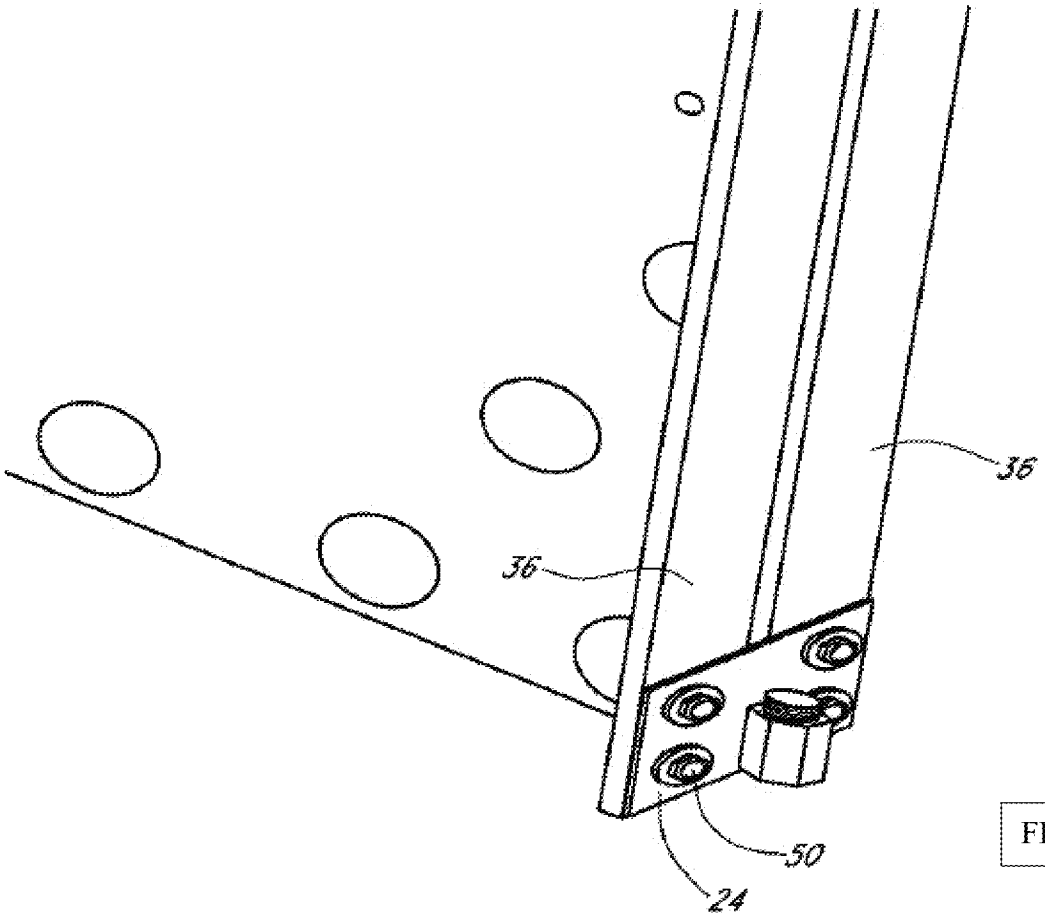
Figure 7:
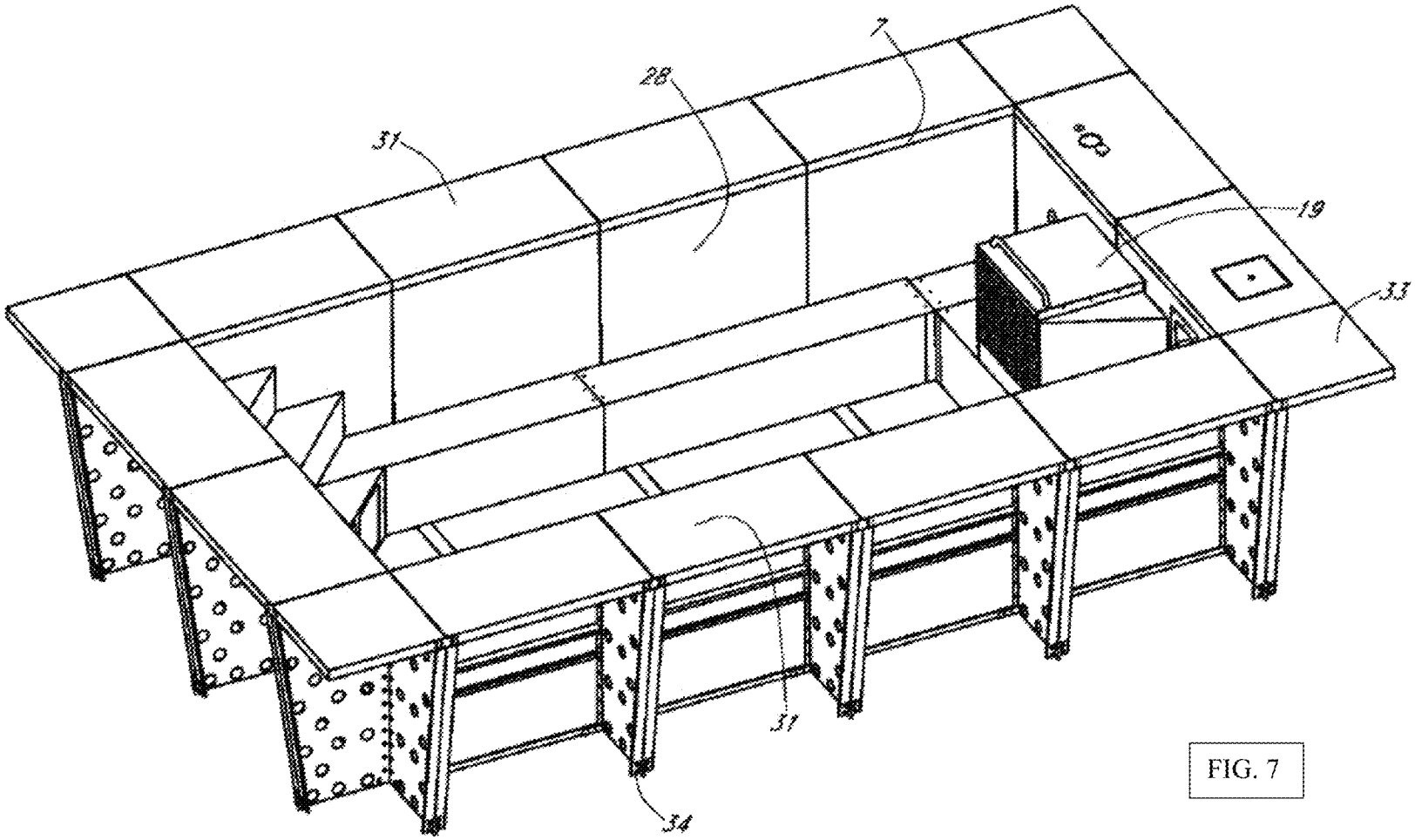
Figure 8:
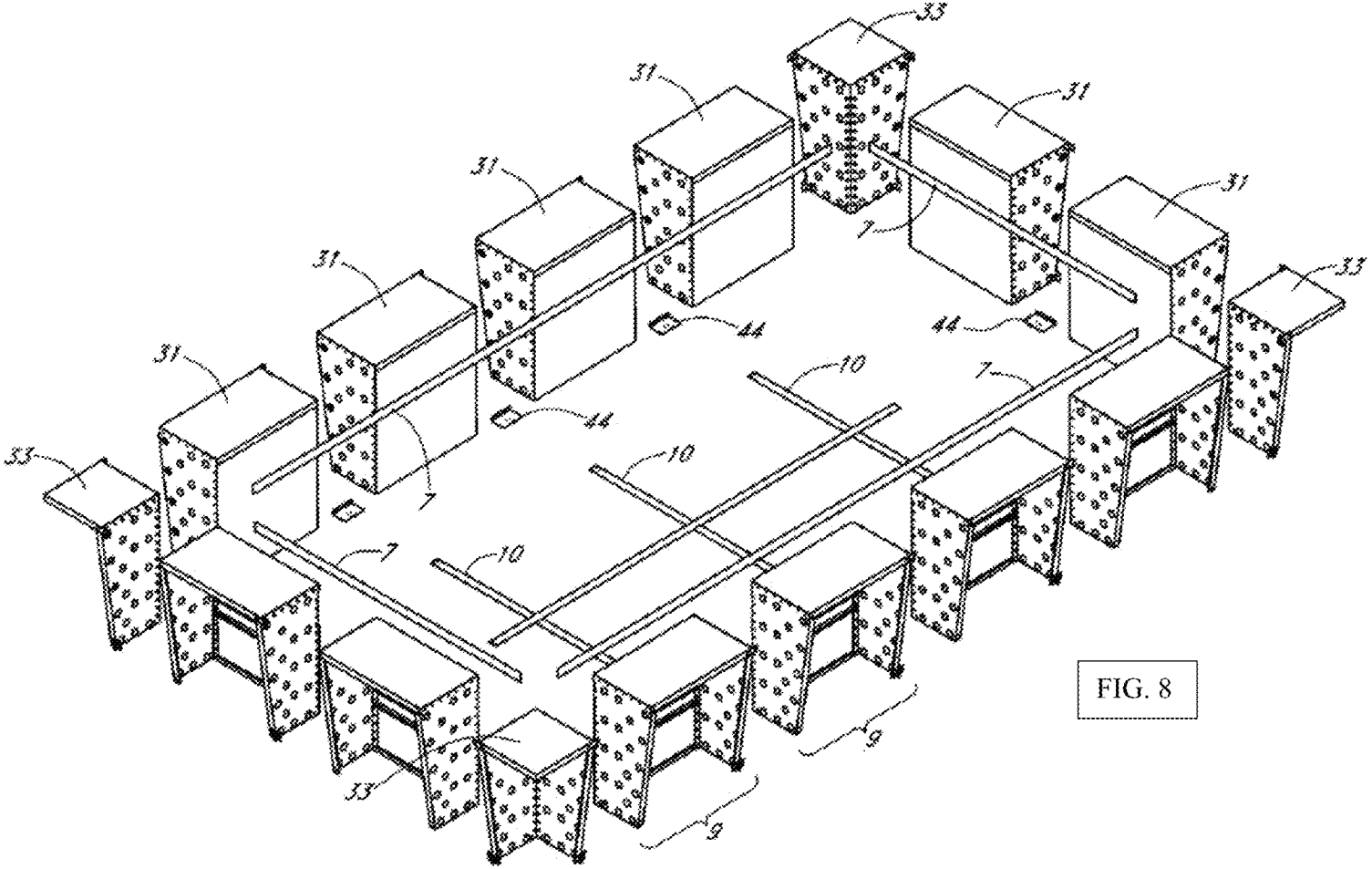
Figure 9:
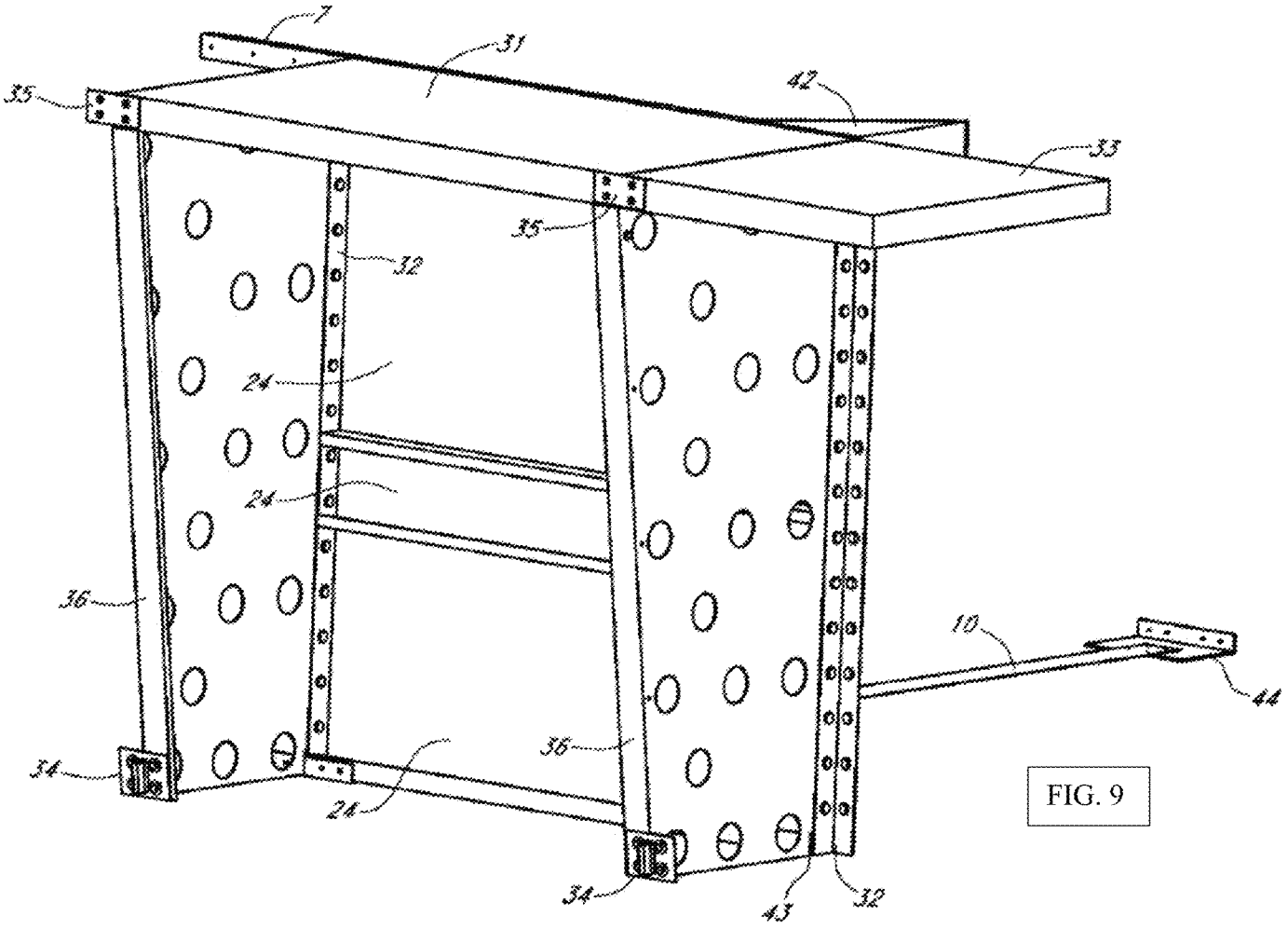
Figure 10:
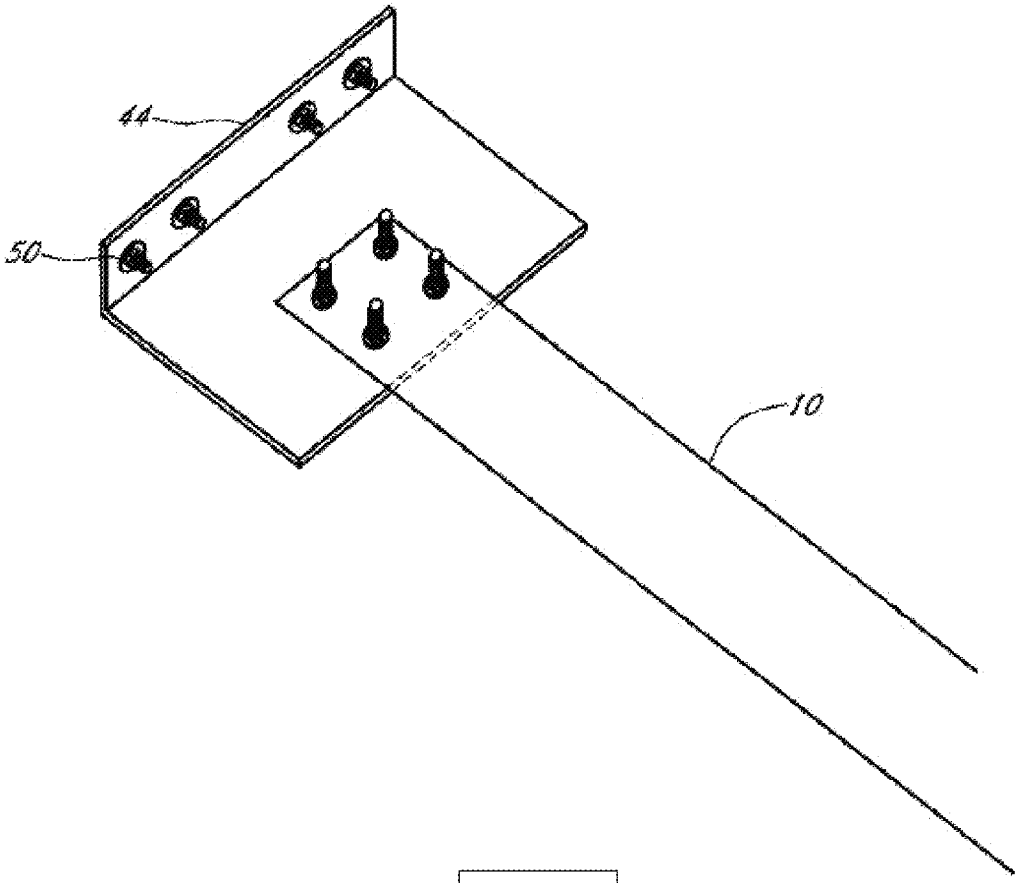
Figure 11:
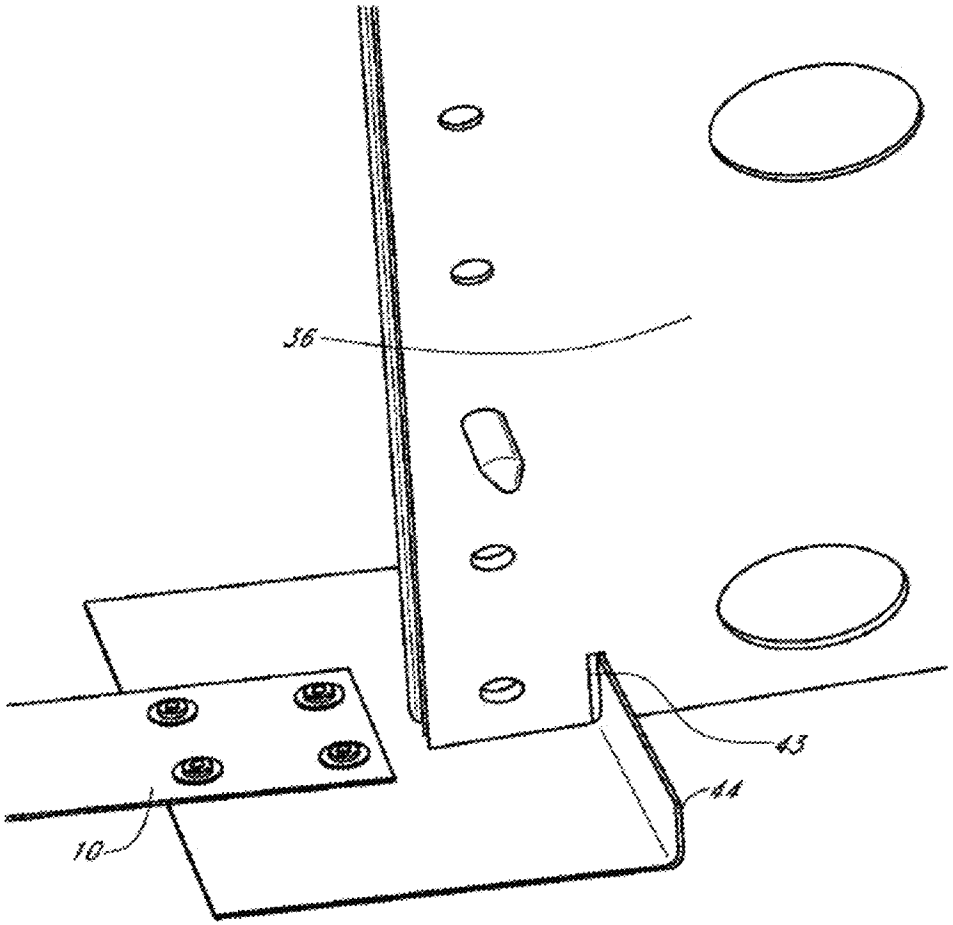
Figure 12:
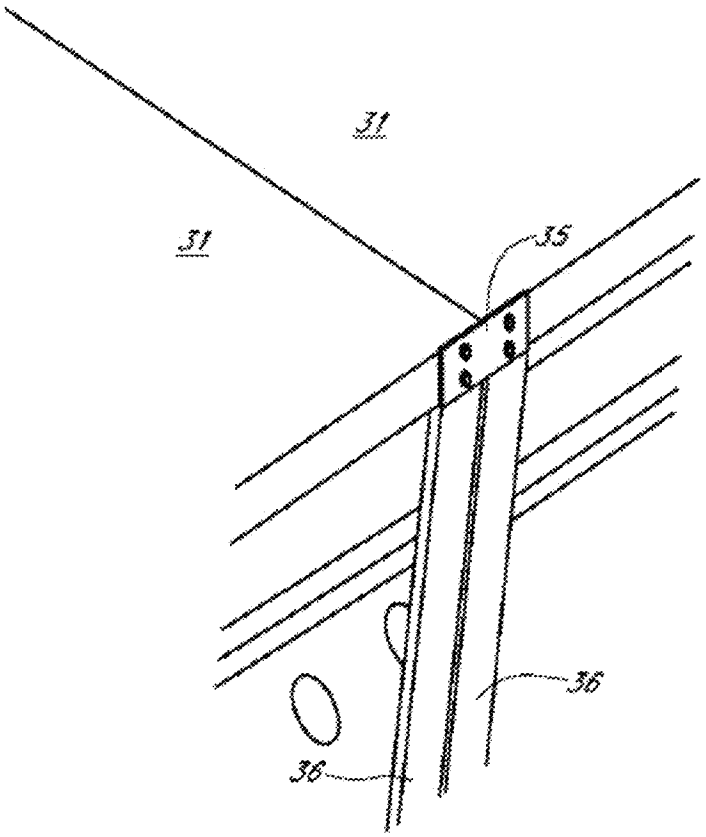
Figure 13:
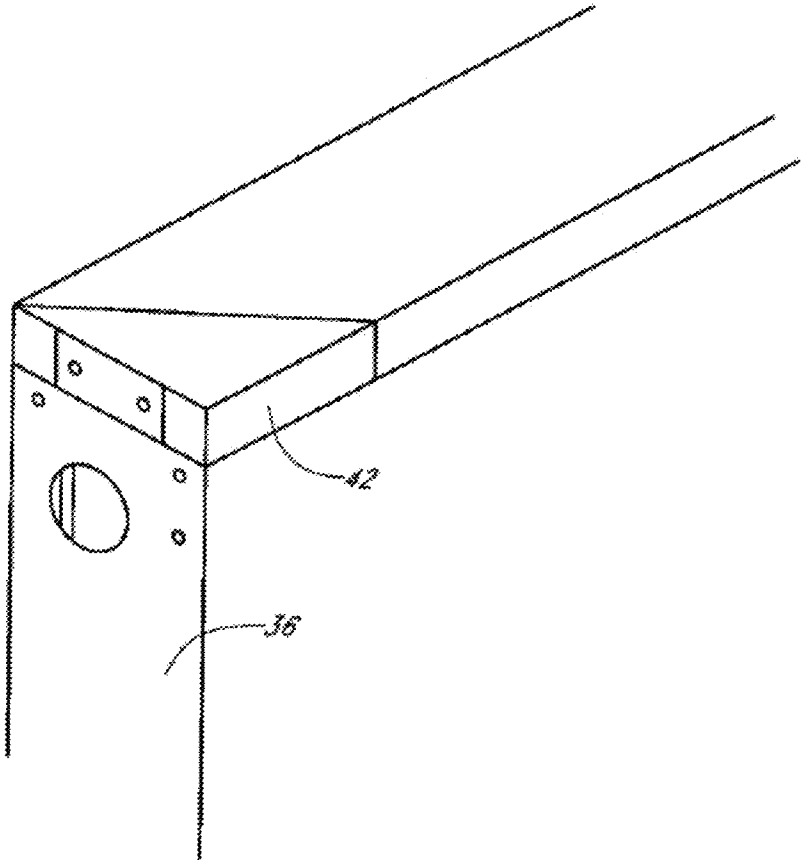
Figure 14:
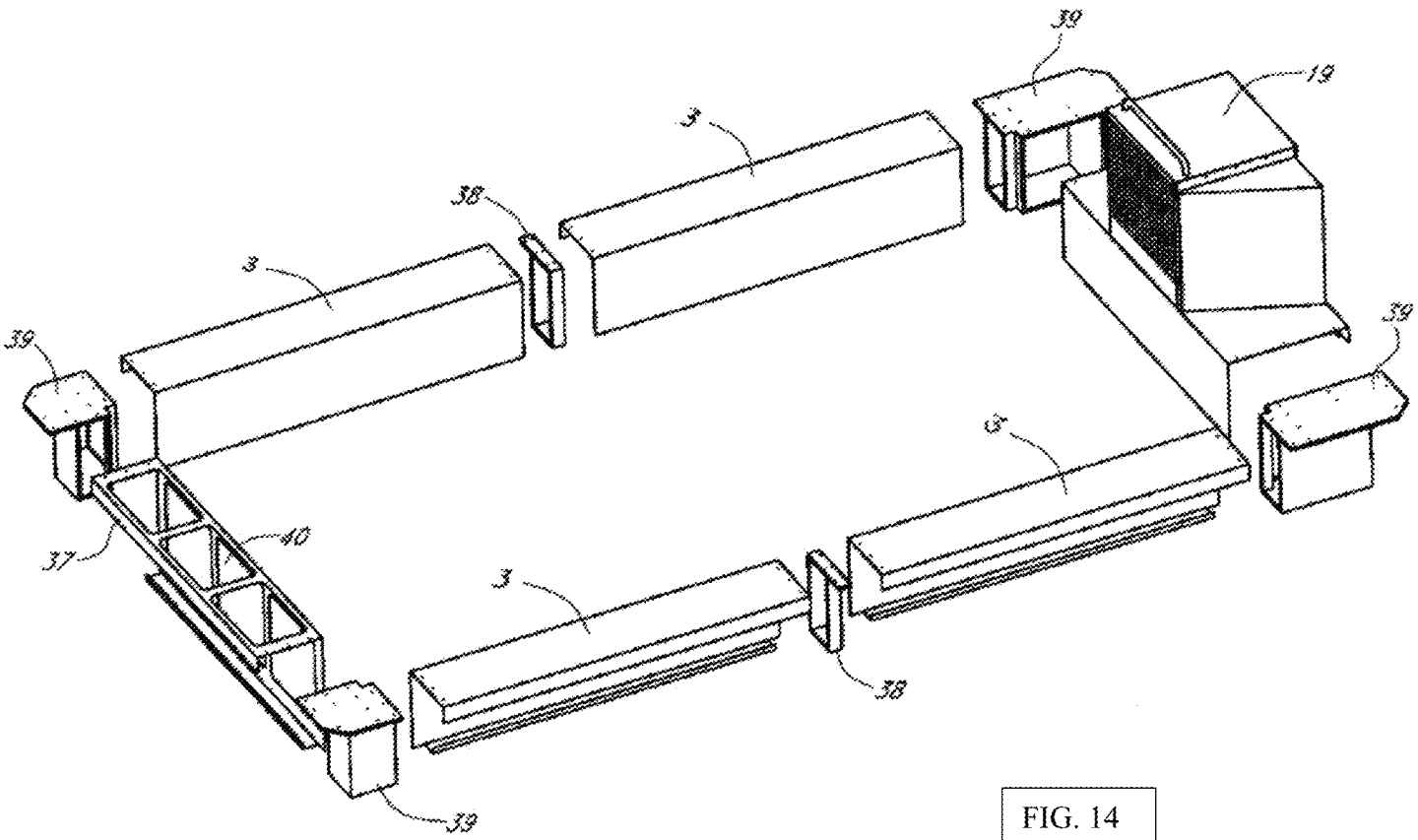
Figure 15:
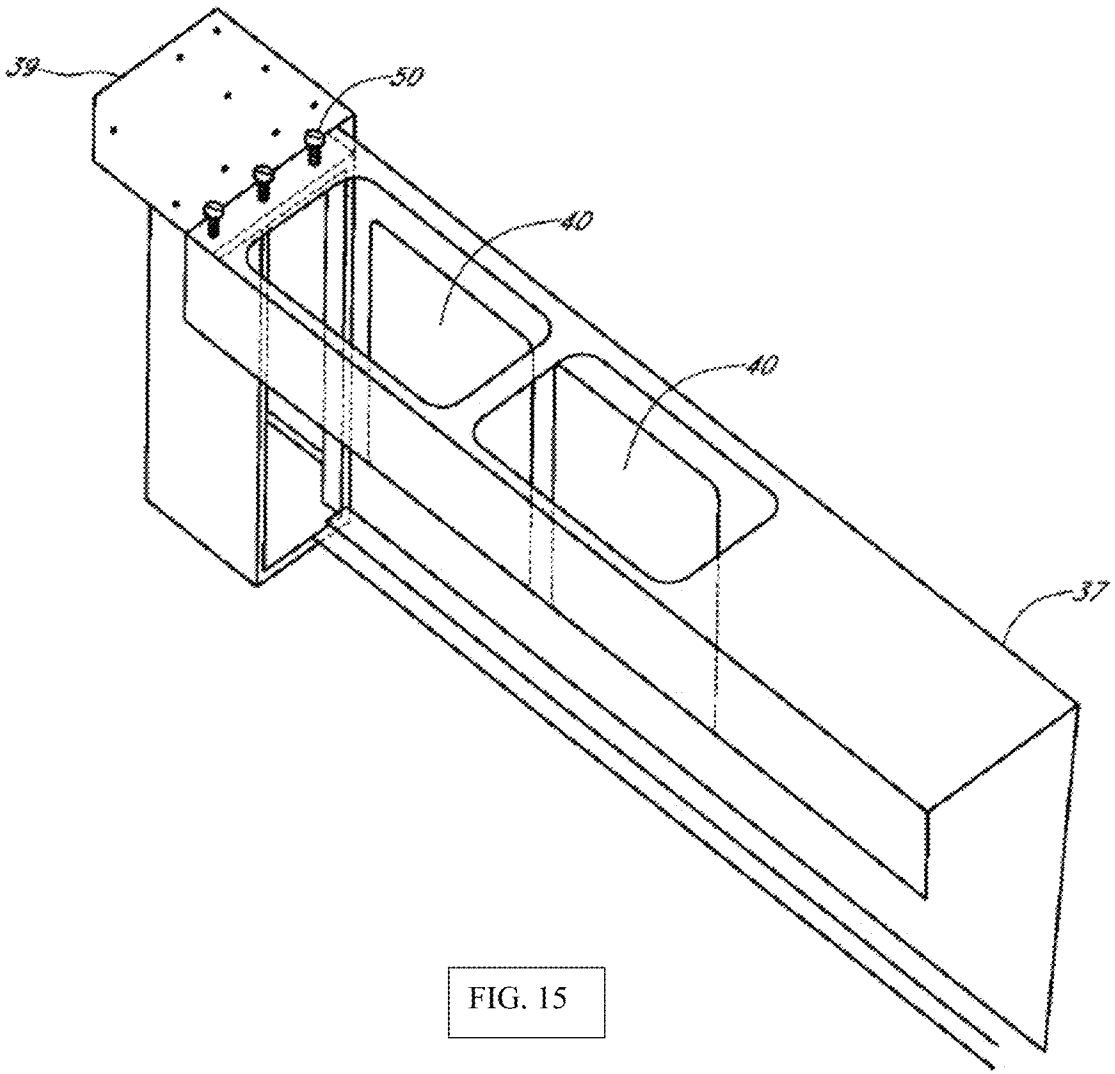
Figure 16:
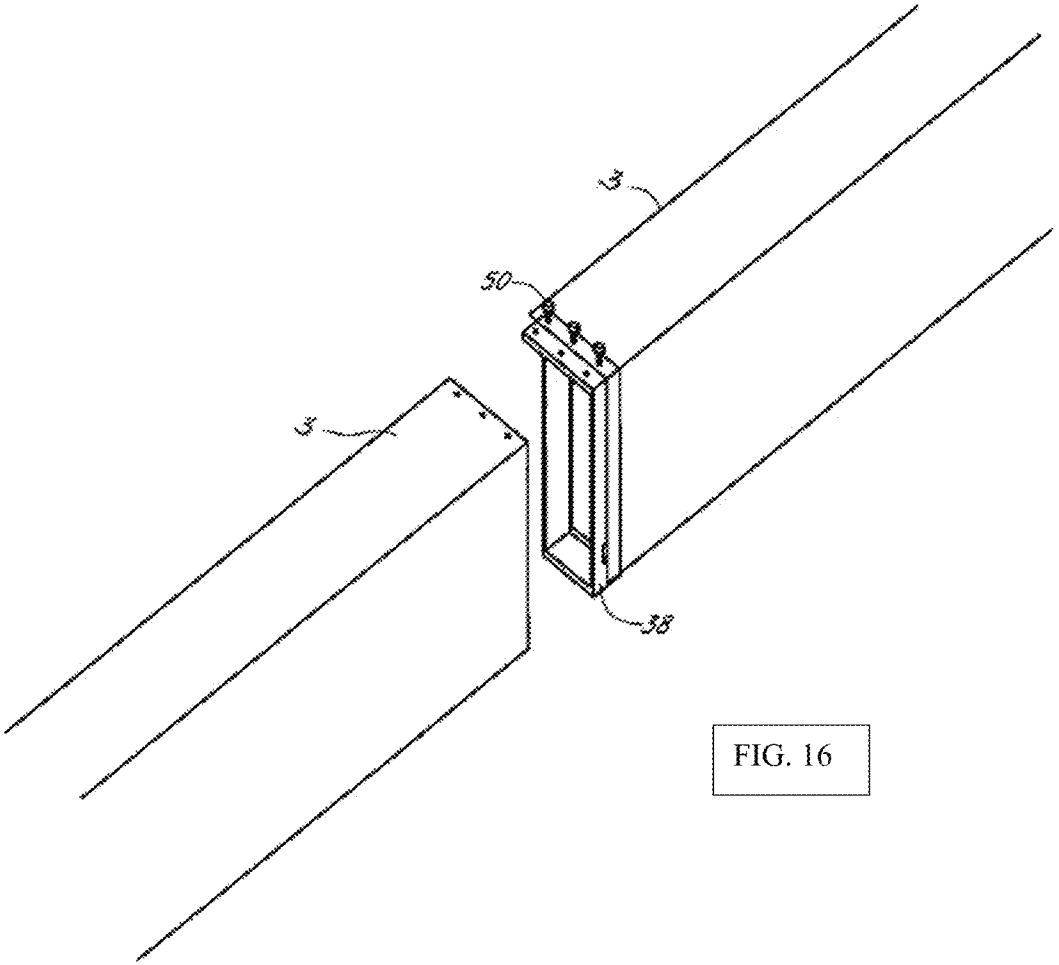

Before the present Exercise Pool is disclosed and described, it is to be understood that the Exercise Pool is not limited to specific methods, specific components, or to particular implementations. It is also to be understood that the terminology used herein is for the purpose of describing particular embodiments only and is not intended to be limiting.

As used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other components, integers or steps. "Exemplary" means "an example of" and is not intended to convey an indication of a preferred or ideal embodiment. "Such as" is not used in a restrictive sense, but for explanatory purposes.

Disclosed are components that can be used to perform the disclosed Exercise Pool as a stand-alone unit, a drop-in unit or as a specially configured pool having a flow head built in. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all Exercise Pool with Circulating Flow. This applies to all aspects of this application including, but not limited to, components of an Exercise Pool with Circulating Flow. Thus, if there are a variety of additional components that can be added it is understood that each of these additional components can be added with any specific embodiment or combination of embodiments of the Exercise Pool with Circulating Flow. The present Exercise Pool with Circulating Flow may be understood more readily by reference to the following detailed description of preferred embodiments and the examples included therein and to the Figures and their previous and following description.

In one embodiment, the Exercise Pool with Circulating Flow may be constructed of material of sufficient strength and durability to support long term use for swimming, exercise and enjoyment. It is contemplated that in the illustrative embodiment shown in the enclosed figures may be constructed of, but not limited to, any metal or combination of metals including bronze, steel, stainless steel and aluminum; plastics or carbon fiber including Kevlar®, foam-blown polyurethane, thermoplastic polyurethane, ethylene vinyl acetate, other polymers, other thermoplastics, carbon rubber, blown rubber polymers, composite materials, natural materials (e.g., rubber, leather, etc.), elastomers, combinations thereof, and/or any other material with suitable characteristics (e.g., compressive strength, stability, elasticity, density). As disclosed and configured, the Exercise Pool may be configured as a flow box for containment or as a container for the flow head components (plenum arrangement 80) referred to herein as a "Self-contained drop-in propulsion unit". As disclosed and configured, the Exercise Pool may also be configured with a removable walk deck 73 which may be configured from aluminum. The flow box may be configured with an air gap 98 above the flow head portion (plenum arrangement 80).

As disclosed and configured, the Exercise Pool may be configured with hydraulic drive motors 89 which may be exposed to and immersed in water 24/7.

As disclosed and configured, the Exercise Pool may be configured with dual propellers which may be reversible. In the dual propeller configuration, the propellers may be configured to be timed and rotating towards each other to produce a common flow. As disclosed and configured, each propeller sits within its own shroud which results in balanced flow which further enhances swim experience. As shown, the propeller system may be positioned in its own section (flowbox) within the self-container propulsion unit 70 for improved safety significantly reducing the potential for body and hair entrapment. As disclosed and configured, the Exercise Pool may be configured with removable walls and grate sections, installed in any length or size. As disclosed and configured, the Exercise Pool may be configured with an adjustable flow head (turning vain) for direction compression flow. As disclosed and configured, Exercise Pool may be configured with multiple flow heads.

APPENDIX A

Figures 17, 17A:
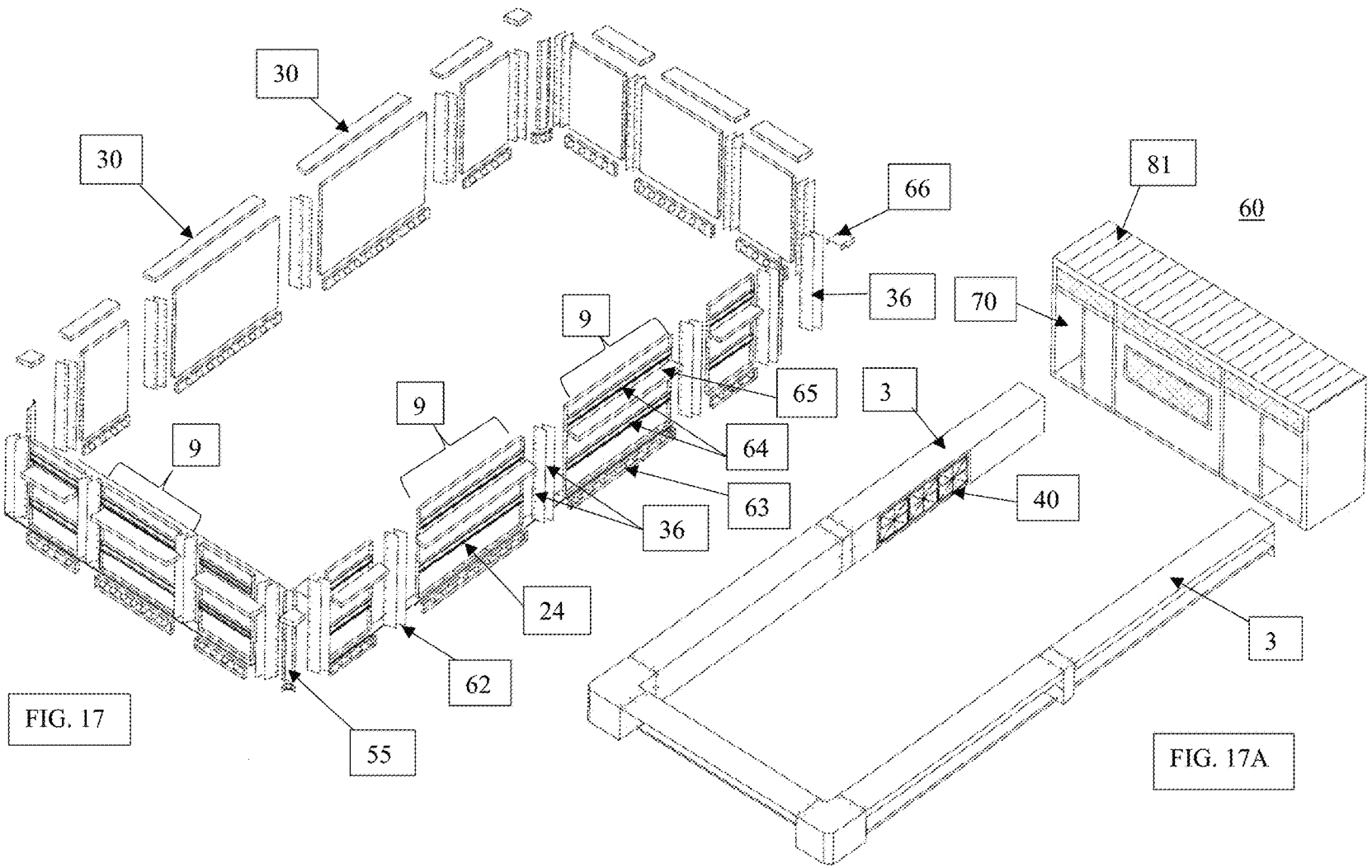
FIG. 17 is an exploded view of another embodiment of the modular wall structure shown in FIGS. 1-16 which may be implemented with the drop-in self-contained propulsion unit disclosed and discussion in FIGS. 17A-24.
FIG. 17A is an exploded view of one embodiment of the self-contained drop-in propulsion unit disclosed illustrated with a set of drop-in flow (water return) tunnels, without restriction or limitation.

Test Report provides a detailed discussion of at least one embodiment of the Exercise Pool disclosed herein including details of operation and construction that demonstrate the safety of the design disclosed herein. Appendix A is incorporated by reference herein. FIG. 17 is an exploded view of another embodiment of the modular interlocking panels 9 used to build a modular pool sidewall (45-48) as shown in FIGS. 1-16 which may be implemented with the drop-in self-contained propulsion unit 70 disclosed and discussion in FIGS. 17A-24. One of ordinary skill will appreciate that the drop-in self-contained propulsion unit 70 may also be used in a pool having sidewalls 45-48 which are not produced with modular interlocking panels 9, without limitation or restriction. FIG. 17A is an exploded view of one embodiment of the self-contained drop-in propulsion unit 70 disclosed and illustrated with a set of drop-in flow (water return) tunnels 3, without restriction or limitation.

Figure 18:
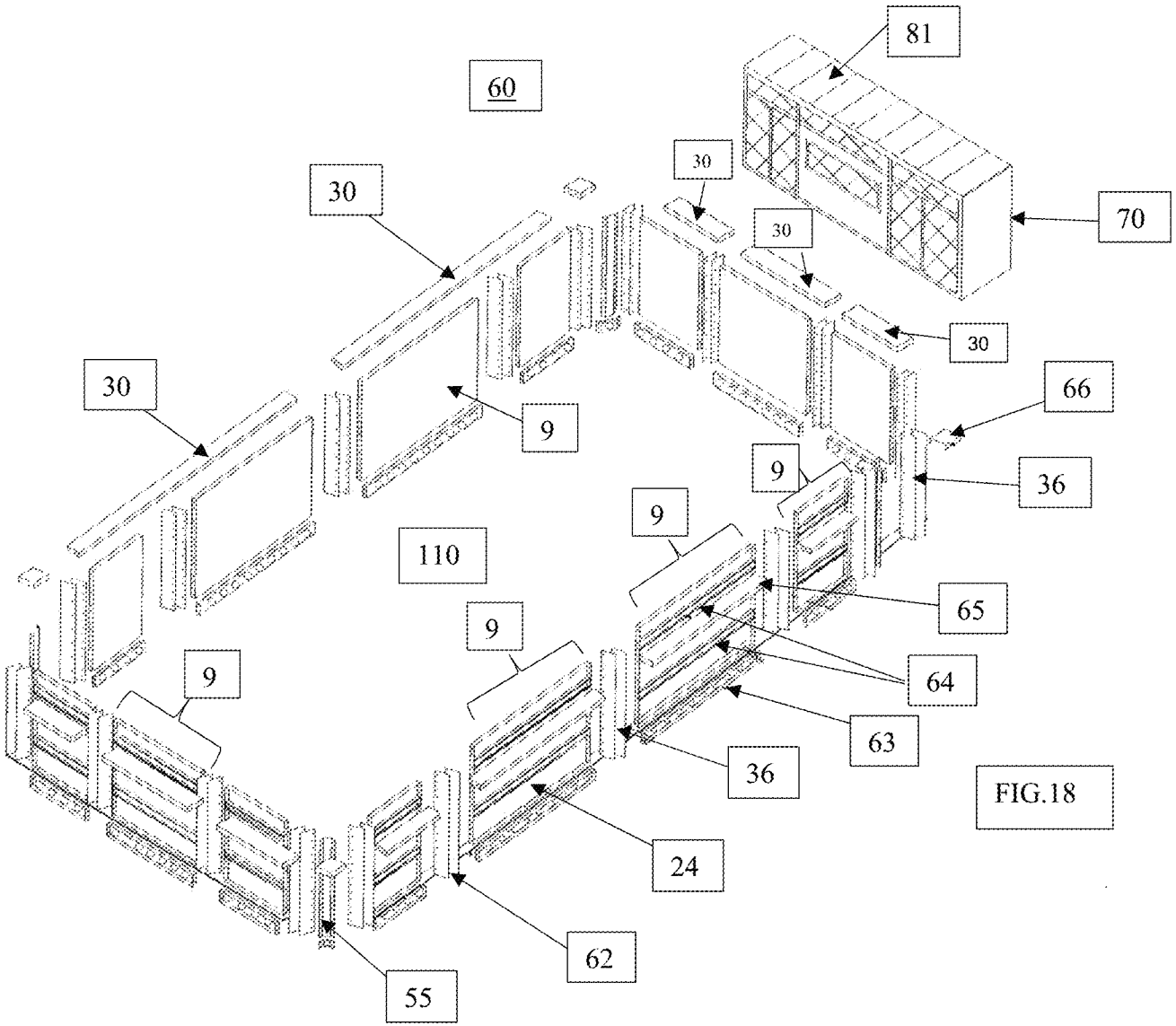
FIG. 18 is an exploded view of another embodiment of the modular wall structure shown in FIGS. 1-16 which may be implemented with the drop-in self-contained propulsion unit disclosed and discussion in FIGS. 17A-24 illustrated without a set of drop-in flow (water return) tunnels, without restriction or limitation.
Figure 19:
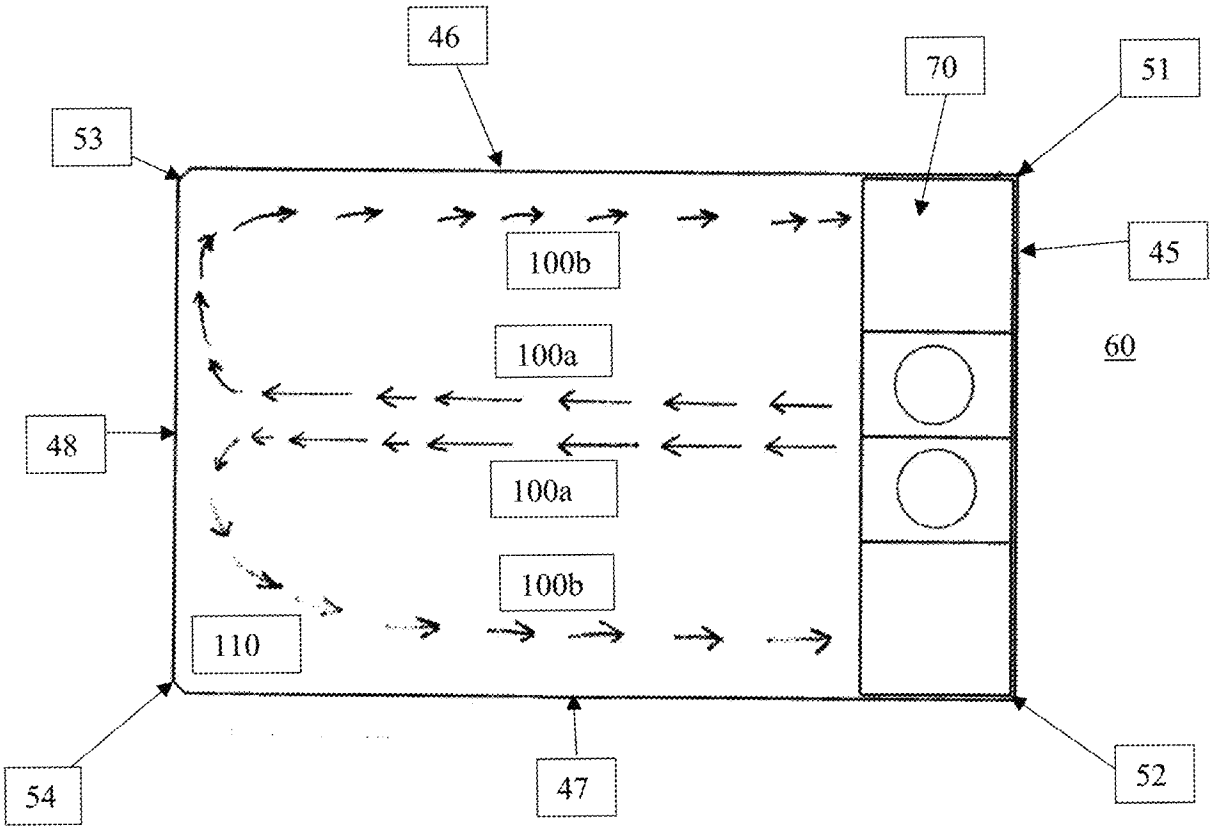
FIG. 19 is a simplified top view of the Exercise Pool disclosed and claimed herein, particularly the drop-in propulsion unit positioned at the head end of the exercise pool illustrating the discharge of the circulating water flow from the self-contained drop-in propulsion unit wherein the circulating water flow forms a pair of circuitous water flow paths in the exercise pool, a first water flow path flowing from the head end to the foot end of the exercise pool, the first water flow path useful for swimming, and a second water flow path from the foot end to the head end of the exercise pool for recirculation.

FIG. 18 is an exploded view of another embodiment of the modular wall structure shown in FIGS. 1-16 which may be implemented with the drop-in self-contained propulsion unit 70 disclosed and discussed in FIGS. 17A-24 illustrated without a set of drop-in flow (water return) tunnels, without restriction or limitation. Both FIG. 17 and FIG. 18 disclose modular interlocking panels 9 comprising a concrete channel 63, a wall stiffener 64 and a top seat 65. A water stop 62 positions between the modular interlocking panels 9 preventing any leakage of the water out of Exercise Pool 60. A corner cap 65 positions on top of the water stop 66 as disclosed herein. FIG. 19 is a simplified top view of the Exercise Pool 60 disclosed and claimed herein, particularly the drop-in propulsion unit 70 positioned at the head end 60*a* of the exercise pool illustrating the discharge of the circulating water flow from the self-contained drop-in propulsion unit 70 wherein the circulating water flow forms a pair of circuitous water flow paths 100 in the exercise pool, a first water flow path flowing from the head end to the foot end 100*a* of the exercise pool, the first water flow path 100*a* useful for swimming, and a second water flow path from the foot end 100*b* to the head end of the exercise pool for recirculation. The exercise pool 60 with a circulating water flow as shown in FIGS. 18-19, is similar to the pool shown in FIGS. 1-16, in that it is also configured to have a first sidewall 45, a second sidewall 46, a third sidewall 47 and a fourth sidewall 48, each sidewall generally non-curved and having a first end (45*a*, 46*a*, 47*a*, 48*a*) and a second end (45*b*, 46*b*, 47*b*, 48*b*), the first end of the first sidewall 45*a* and the first end of the second sidewall 46*a* forming a first corner of the exercise pool 51, the second end of the first wall 45*b* and the first end of the third wall 47*a* forming a second corner of the exercise pool 52, the first and second corners forming the head end of the exercise pool 60*a*, the second end of the second wall 46*b* and the first end of the fourth wall 48*a* forming a third corner of the exercise pool 53, the second end of the third wall 47*b* and the second end of the fourth wall 48*b* forming a fourth corner of the exercise pool 54, the third and fourth corners forming the foot end of the exercise pool 60.

Figure 20:
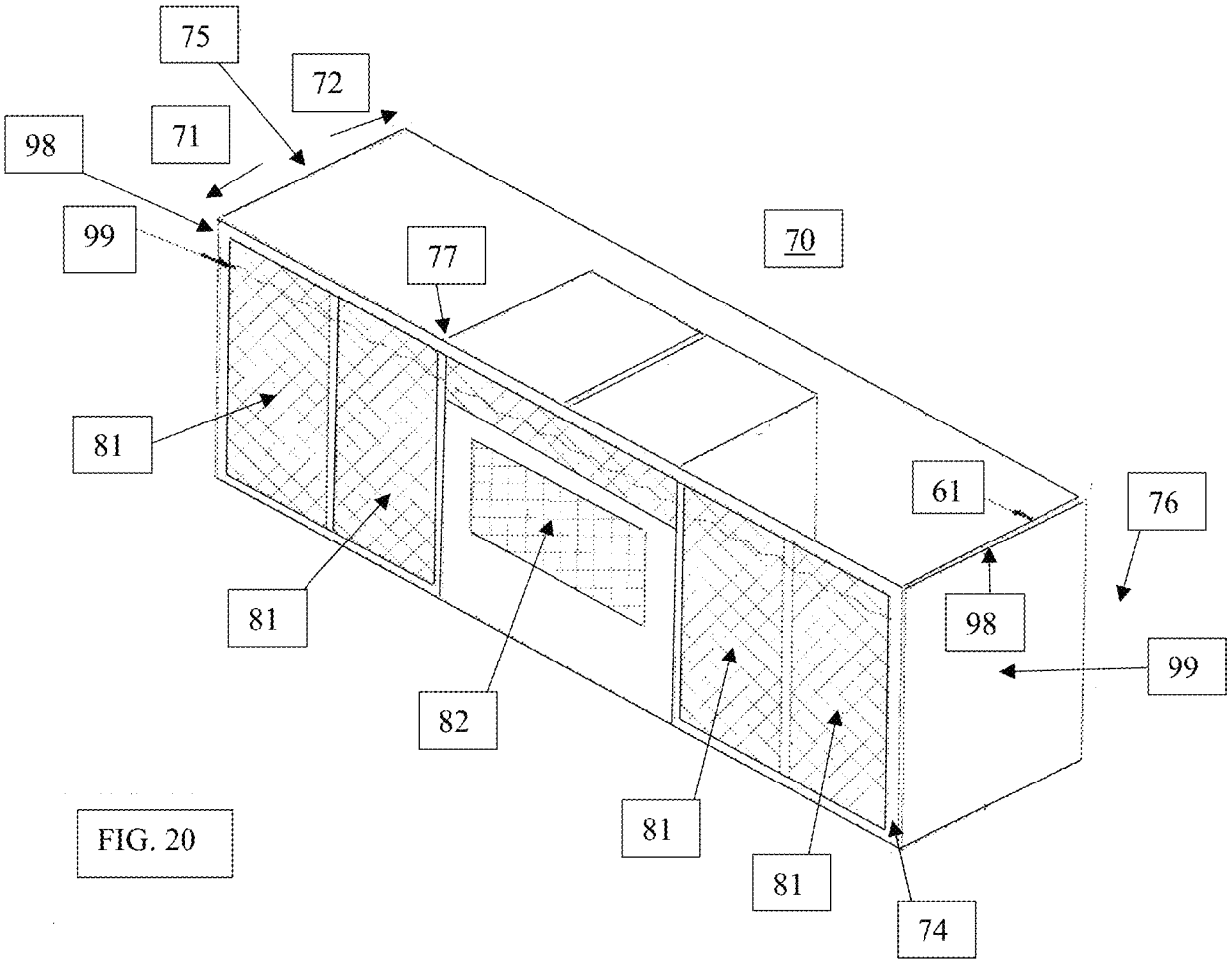
FIG. 20 is an illustrative perspective view of one embodiment of the self-contained drop-in propulsion unit, illustrating with particularity the plenum arrangement including the common outlet and the plurality of water inlets in relation to the water line and air gap during operation. As shown, the upper portion has been removed.
Figure 20A:
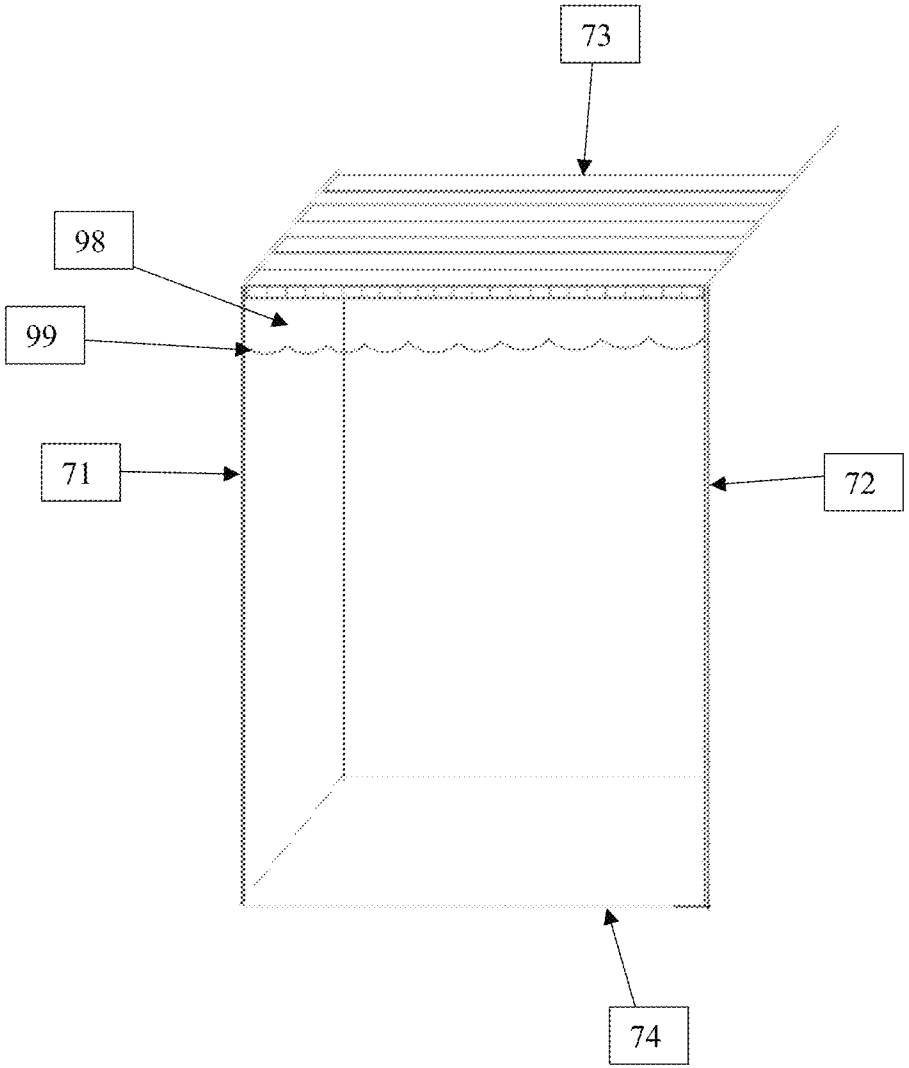
FIG. 20A is a side view of the self-contained drop-in propulsion unit with upper portion in place.
Figure 20B:
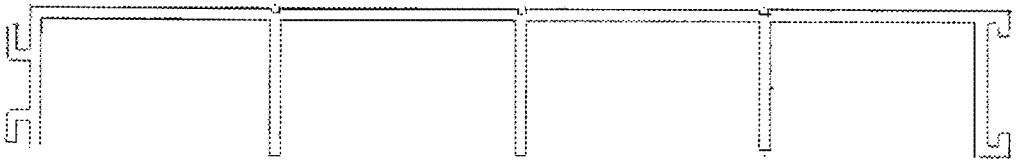
FIG. 20B is a side view of the top side lid (configured as a walkway) removed from the self-contained propulsion unit.
Figure 27:
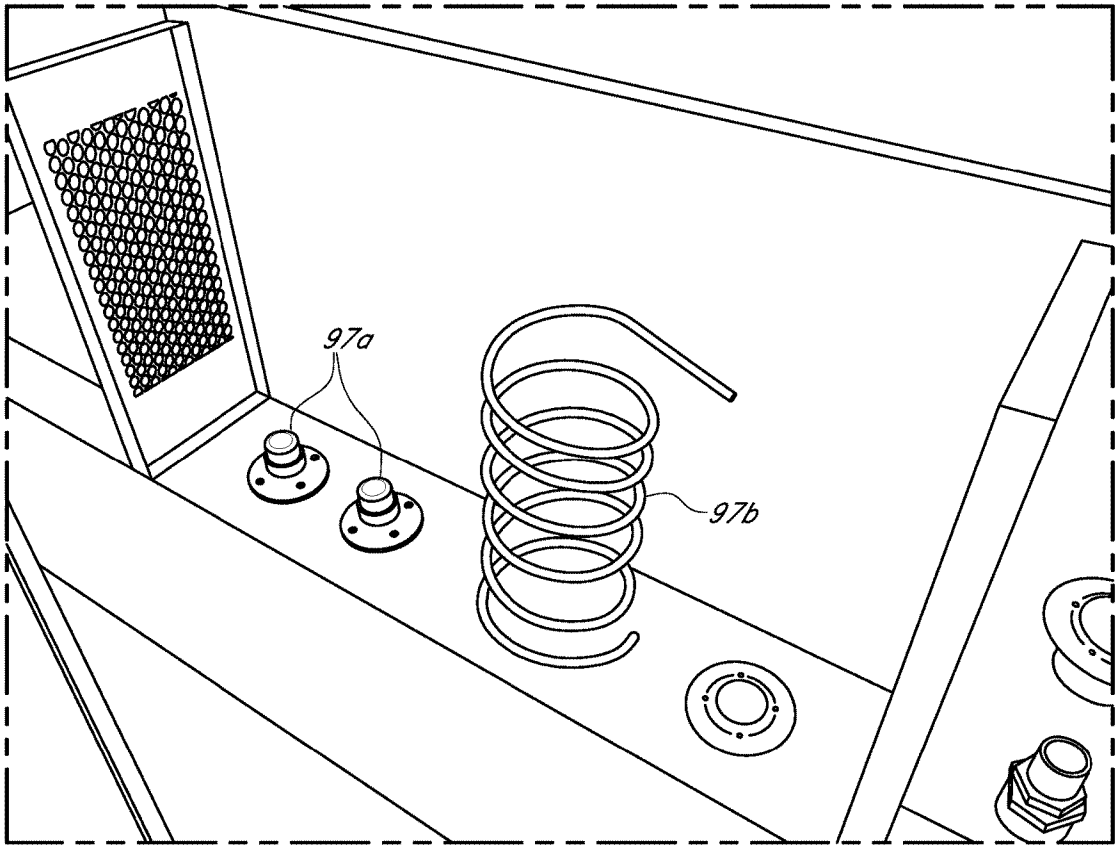
FIG. 27 is a perspective view of the hydraulic fluid pumping system manifold of the plenum arrangement and the hydraulic fluid cooler which may be positioned therein.
Figure 28:
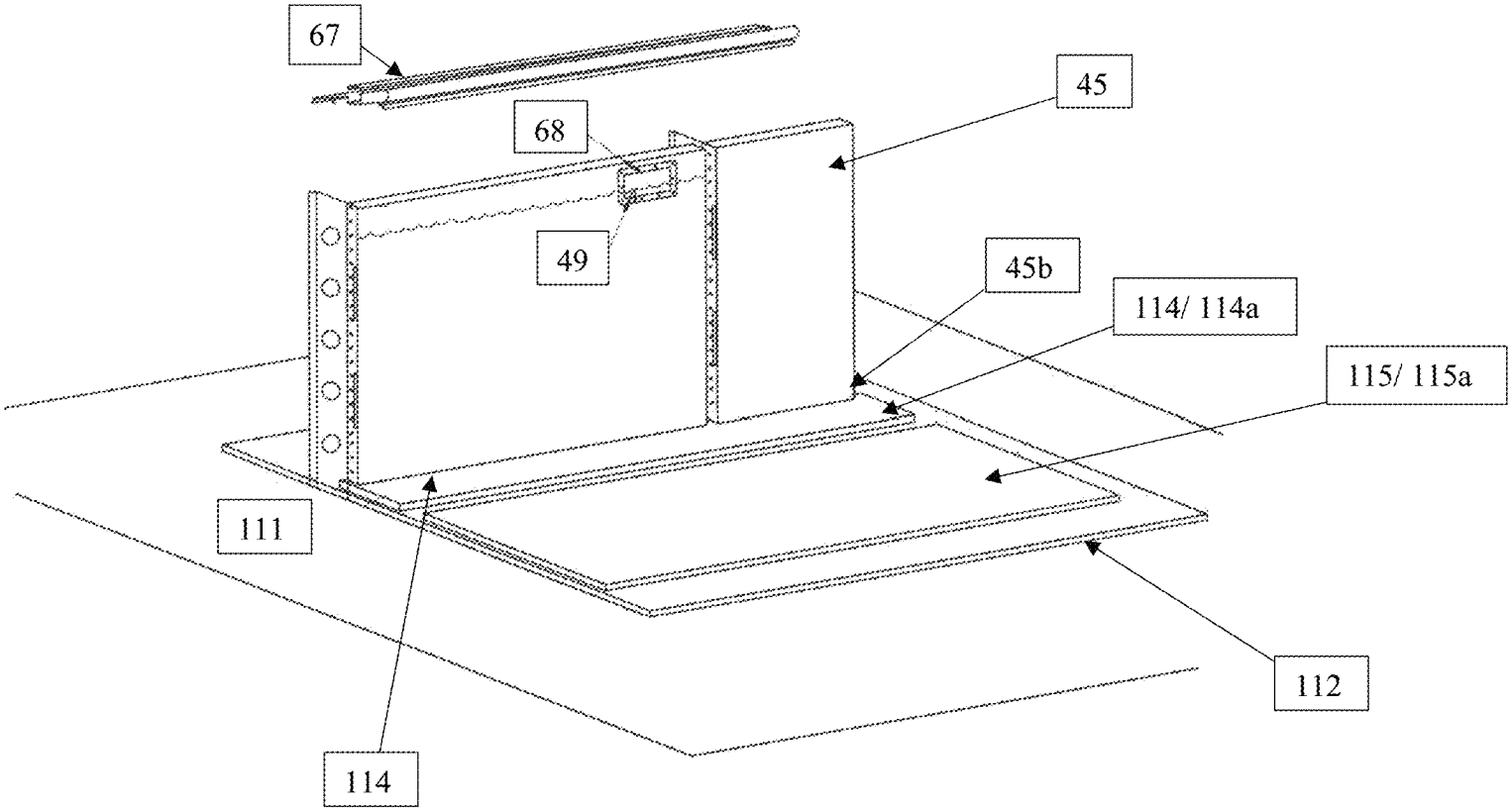
FIG. 28 is a perspective view of pool floor fabrication method and structure useful in reducing construction time and improving outcomes herein.

As shown in FIG. 19 and FIG. 28, the exercise pool floor 110 is positioned below and connected to the bottom of the first sidewall 45, the second sidewall 46, the third sidewall 47 and the fourth sidewall 48, wherein the exercise pool floor 110 is generally non-sloped. As disclosed and discussed, the pool floor 110 may be constructed from multiple layers. See FIG. 28 As shown in FIGS. 17-27, as self-contained drop-in propulsion unit 70 may be positioned on the exercise pool floor 110 between the first and second corners of the exercise pool (51, 52), defined as the head end (60*a*), the self-contained drop-in propulsion unit shown in detail in FIGS. 20-26 as discussed herein. FIG. 20 is an illustrative perspective view of one embodiment of the self-contained drop-in propulsion unit 70, illustrating with particularity the plenum arrangement 80 including the common outlet 82 and the plurality of water inlets 81 in relation to the air gap 98 and water level 99 during operation. As shown, the top side 73 may be configured as a walkway and has been removed. FIG. 20A is a side view of the self-contained drop-in propulsion unit 70 with top side 73 in place. FIG. 20B is a side view of the top side lid (configured as a walkway) removed from the self-contained propulsion unit 70.

Figure 21:
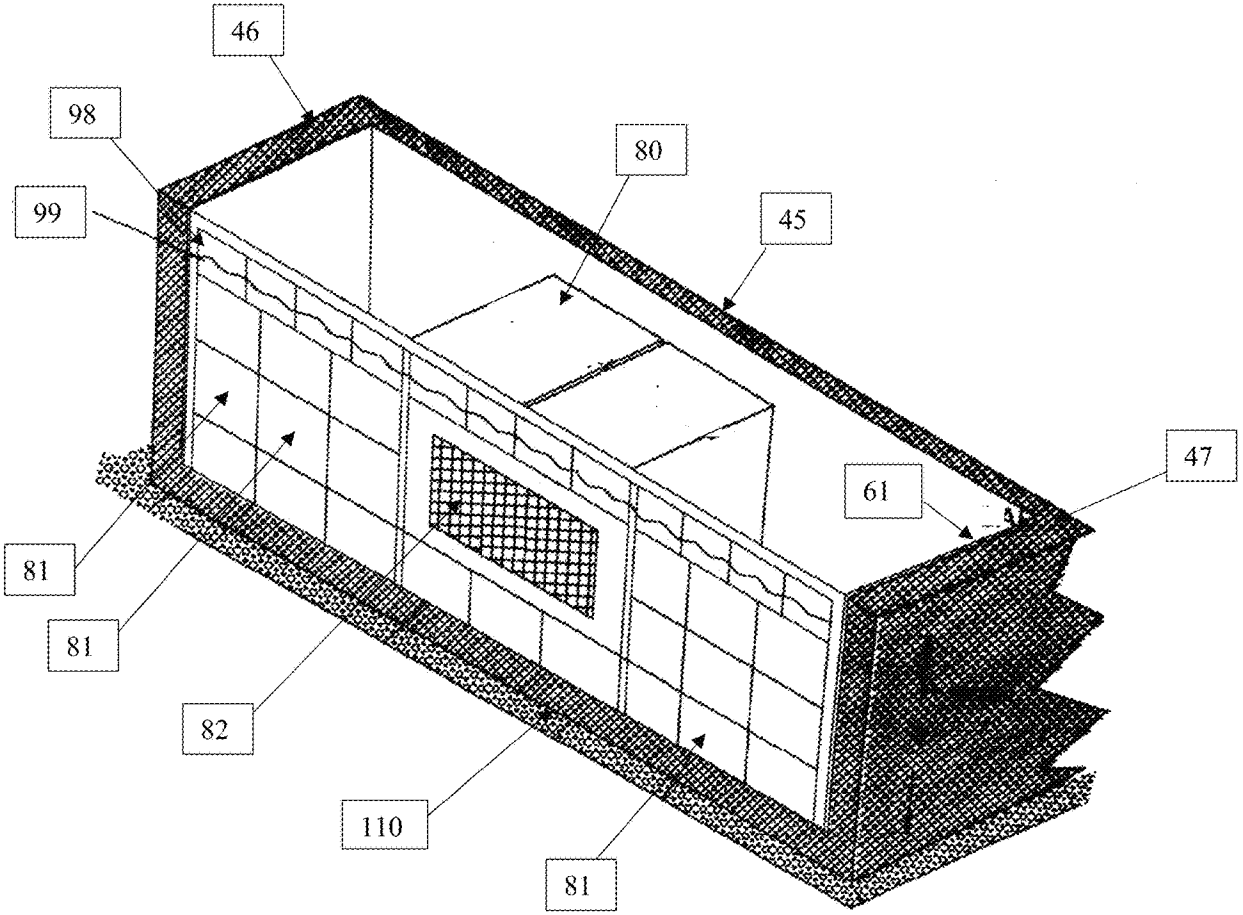
FIG. 21 is perspective view of another embodiment of the self-contained drop-in propulsion unit with the upper portion removed and positioned in the first and second corners of pool having walls.
Figure 21A:
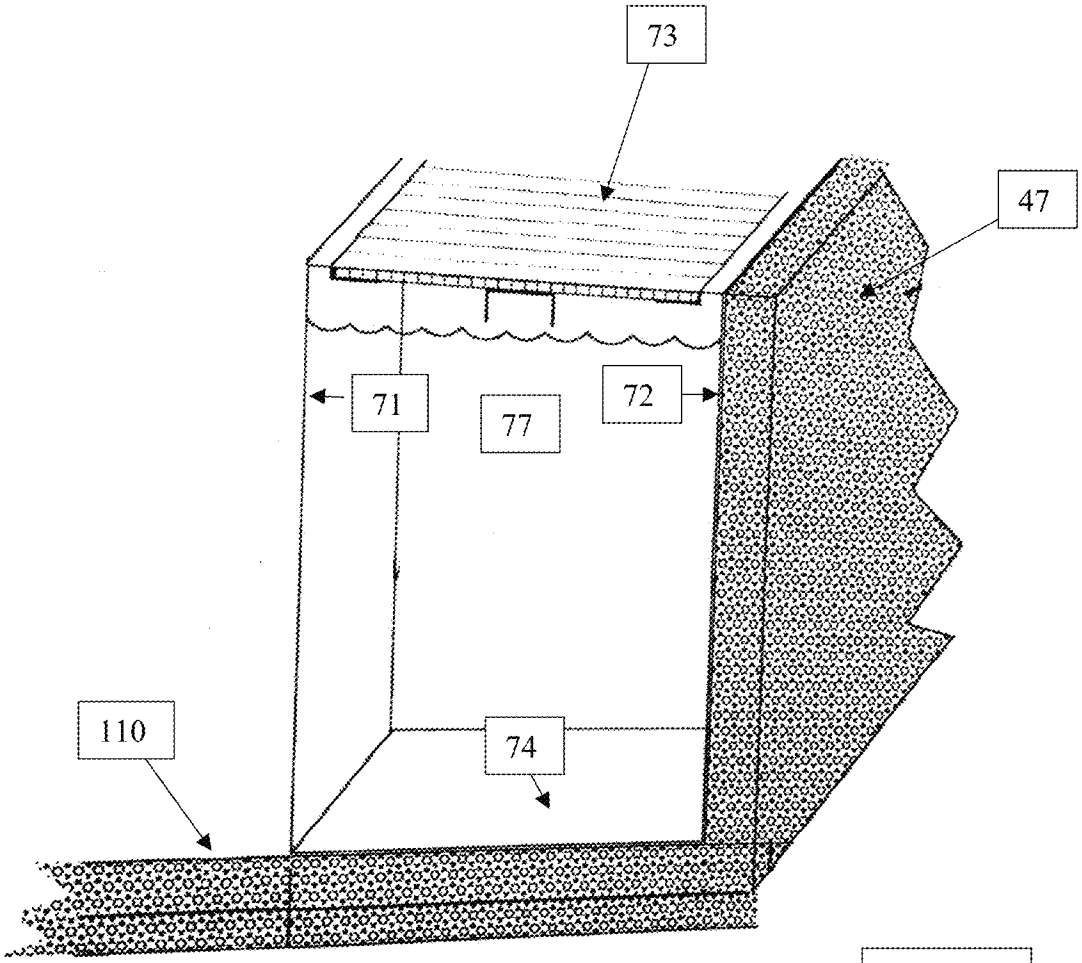
FIG. 21A is an end view of the embodiment shown at FIG. 21A with the top side lid of FIG. 20B in position with a portion of the pool side wall removed to better illustrate the end view.

FIG. 21 is perspective view of another embodiment of the self-contained drop-in propulsion unit 70 with the top side removed 73 and positioned in the first and second corners (51, 52) of the exercise pool having walls (45,46 and 47). FIG. 21A is an end view of the embodiment shown at FIG. 21A with the top side lid of FIG. 20B in position with a portion of the pool sidewall 47 removed to better illustrate the end view.

Figure 22:
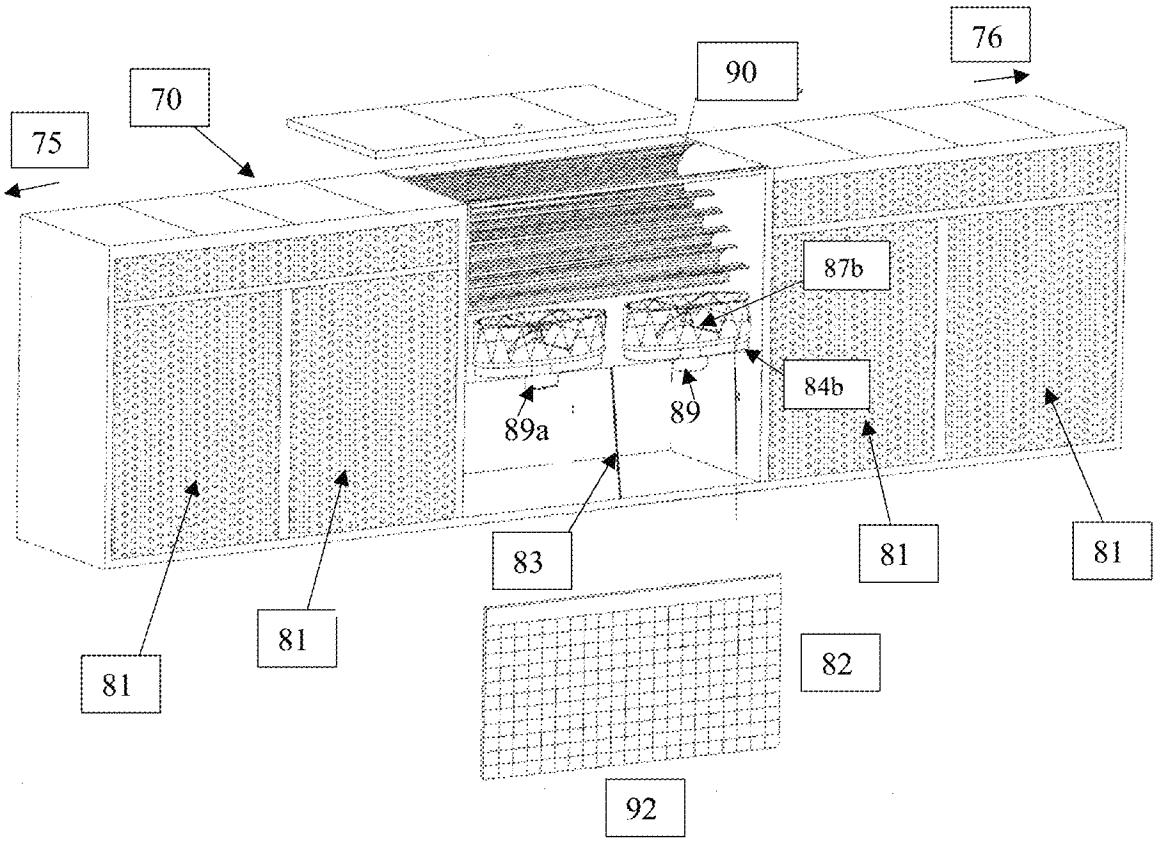
FIG. 22 is an illustrative perspective view of the self-contained drop-in propulsion unit and plenum arrangement. A portion of the grating covering the common outlet has been removed to better expose the set of curved vanes, pair of propellers, hydraulic drive motors and equalization wall

FIG. 22 is an illustrative perspective view of the self-contained drop-in propulsion unit 70 and plenum arrangement 80. A portion of the grating covering the common outlet 82 has been removed to better expose the set of curved vanes 90, the pair of propellers 87, hydraulic drive motors 89 and equalization wall 83. One of ordinary skill will appreciate that both the common outlet 82 and the plurality of inlets 81 may be configured as a grate or with grating 92, as suitable for a particular application. The dimensions of each particular "opening" within a particular grate are unimportant. As shown herein a flow grate having one inch by one-inch (1.0×1.0) openings is acceptable and suitable. In other applications, acceptable performance was achieved using grating having one inch by 0.375 inch (1.0×3/8). As shown herein, the grating may be larger pieces, see FIG. 20 illustrating four pieces of grating covering the plurality of inlets 81 compared to twenty-one (21) individual pieces of grating 92 covering the plurality of inlets 81 in FIG. 23. The number, size and arrangements are solely dependent what is suitable for a particular application as desired by the market and the user requirements—durability, performance, cost, etc.

Figure 22A:
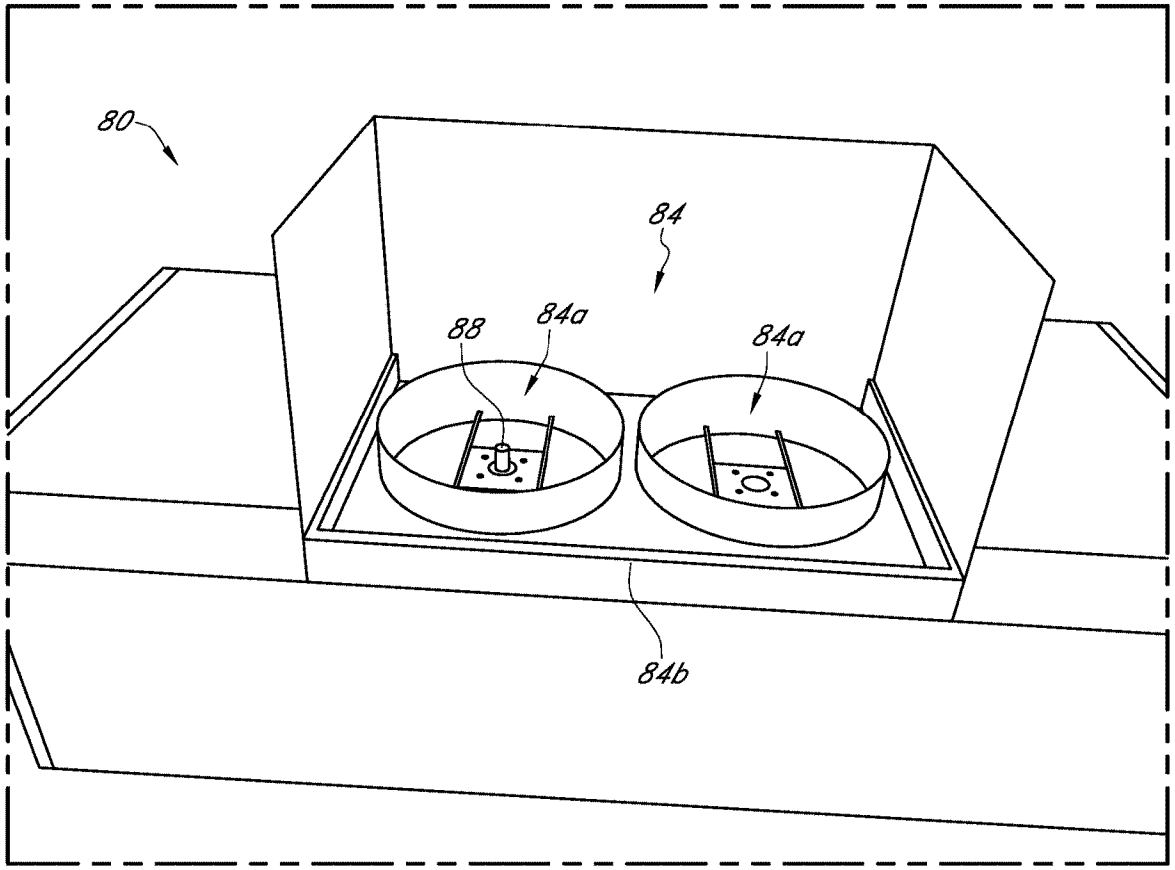
FIG. 22A is a top view of the plenum arrangement of the self-contained drop-in propulsion unit with the propellers removed to better expose the plenum and propeller shrouds.
Figure 22B:
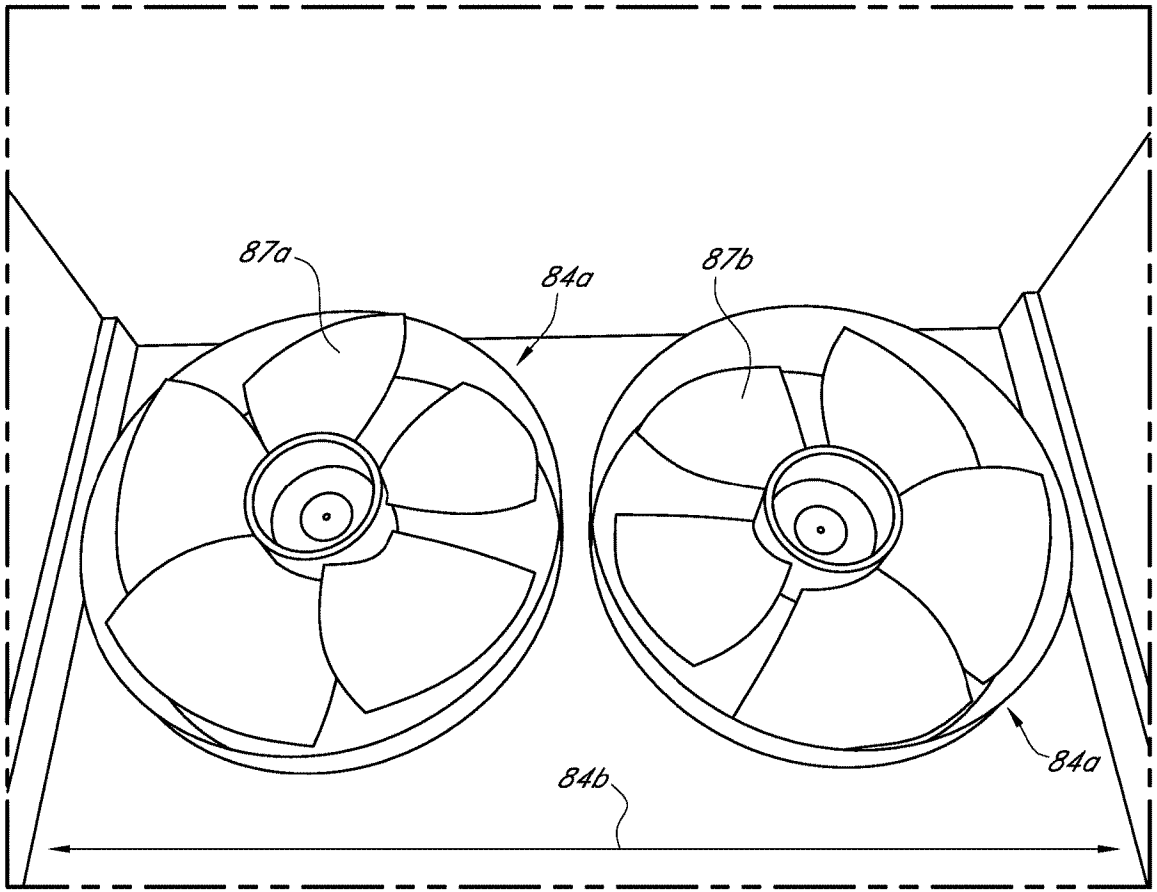
FIG. 22B is a top view of the pair of propeller used to generate and drive the circulating water flows transmitted from the self-contained drop-in propulsion unit. As shown, the propellers are left hand and right hand and timed to work together, rotating towards each other, to generate a symmetric flow for an enhanced user experience and return flow without return channels along the sides of the pool walls or flow diversion devices located at the foot end of the exercise pool.
Figure 22C:
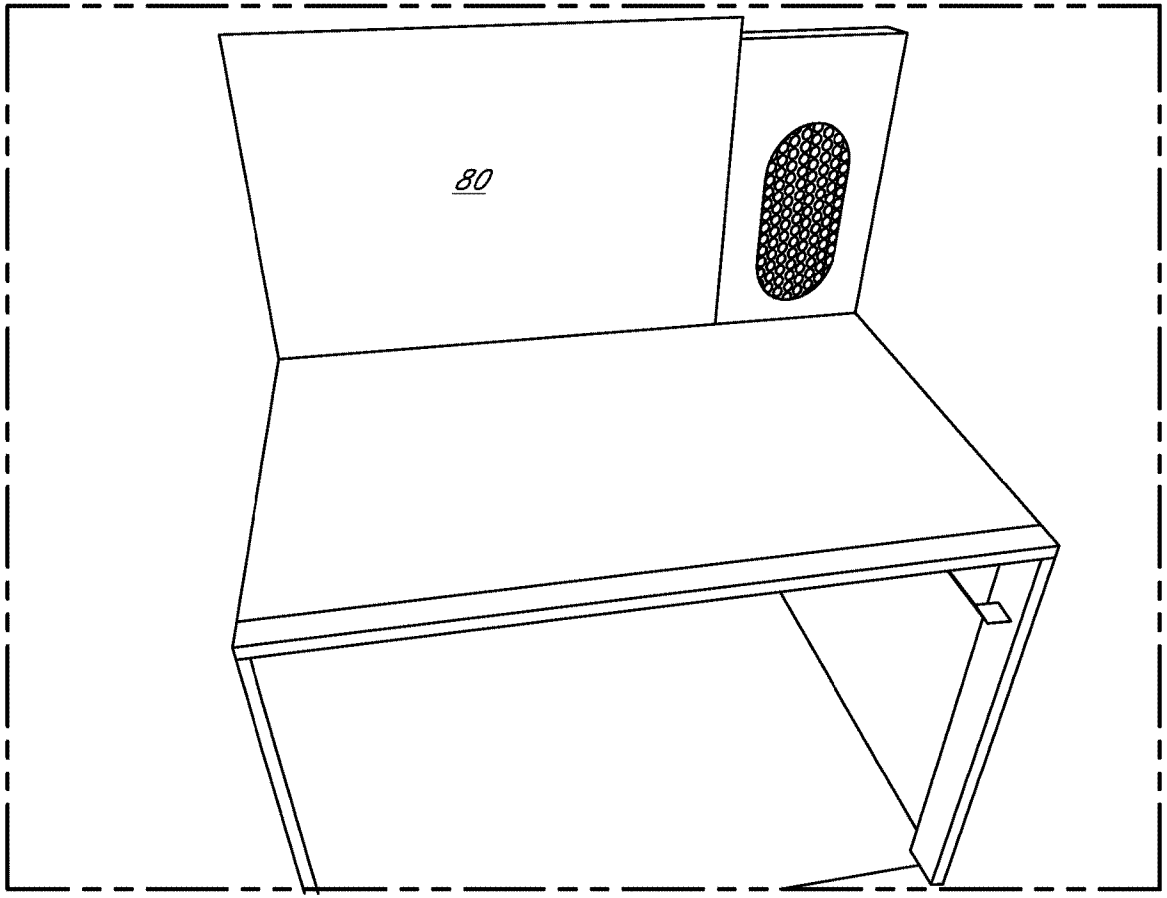
FIG. 22C is an end view of the plenum arrangement used in the self-contained drop-in propulsion unit. As shown herein, the plenum arrangement is fabricated from stainless steel.

As described and disclosed, the self-contained drop-in propulsion unit 70 is to be positioned on the exercise pool floor 110 between the first and second corners of the exercise pool (51, 52), defined as the head end (60*a*), the self-contained drop-in propulsion unit having a front side 71, a back side 72, a top side 73, a left end 75, a right end 76 and a bottom side 74 enclosing an interior 77, wherein the bottom side 74 is configured to rest on the exercise pool floor 110, wherein the back side 72 is configured to be positioned against the first sidewall 45. The self-contained drop-in propulsion unit 70 is configured with an internally positioned plenum arrangement 80 that supports circulating a water flow to and from the adjacently positioned inner water containment are 2. The plenum arrangement is configured with at least a pair of propellers 87 positioned in the interior of the plenum arrangement 80, the pair of propellers positioned adjacent each other and in a common horizontal plane as shown in FIGS. 22, 22A and 22B. Each propeller (87*a*, 87*b*) of the pair of propellers 87 is configured for rotation towards the adjacent propeller in the horizontal plane. As shown in FIG. 22A, the propeller housing 84 includes propeller shroud 84*a* positioned on the propeller plate 84*b* which is positioned in the horizontal plane. Each propeller 87*a*, 87*b* is coupled to a hydraulic motor 89 (illustrated conceptually in FIG. 22), which for coupling to externally positioned hydraulic system. FIG. 22C is an end view of the plenum arrangement 80 used in the self-contained drop-in propulsion unit 70. As shown herein, the plenum arrangement 80 is fabricated from stainless steel but could be fabricated from other materials as is well known to one of ordinary skill in the art. As shown throughout the figures and in particular FIGS. 22 and 23, a plurality of water inlets are positioned in the front side of the plenum arrangement 80 (and thus the self-contained drop-in propulsion unit 70) to allow a circulating water flow to enter the interior of the self-contained drop-in propulsion unit 70 for communication with the pair of propellers 87. FIG. 22A provides a top view of the plenum arrangement 80 with the propellers removed to better expose the plenum arrangement 80, propeller housing 84, propeller shroud 84*a* and propeller plate (horizontal plane) 84*b*. FIG. 22B is a top view of the pair of propellers 87 used to generate and drive the circulating water flows transmitted from the plenum arrangement 80 of the self-contained drop-in propulsion unit 70. As shown, the propellers are left hand (87*a*) and right hand (87*b*) and timed to work together, rotating towards each other, to generate a symmetric flow for an enhanced user experience and return flow without return channels along the sides of the pool sidewalls (46, 47) or flow diversion devices located at the foot end of the exercise pool 60*b*.

As shown in FIG. 22, an equalization wall 83 is positioned in the plenum arrangement 80, the equalization wall 83 positioned between the plurality of water inlets 81 and the pair of propellers 87, the equalization wall 83 configured to balance the quantity of the circulating water flow to and between the pair of propellers 87. A set of curved vanes 90 is located in the plenum arrangement 80 and positioned above the pair of propellers 87, the set of curved vanes 90 configured to engage with and turn the circulating water flow from the pair of propellers 87 in a generally vertical direction to a generally horizontal direction. (See FIG. 22 for additional detail)

The common outlet 82 is then positioned in the front side of the self-contained drop-in propulsion unit 71 and in fluid communication with the set of curved vanes 90 of the plenum arrangement 80, the common outlet configured to allow discharge of the circulating water flow from the plenum arrangement 80 of the self-contained drop-in propulsion unit 70 wherein the circulating water flow forms a pair of circuitous water flow paths in the exercise pool 100, a first water flow path flowing from the head end to the foot end of the exercise pool 100*a*, the first water flow path useful for swimming, and a second water flow path from the foot end to the head end of the exercise pool for recirculation through the plenum arrangement by the pair of propellers via the plurality of water inlets in the front side of the self-contained drop-in propulsion unit. See FIG. 19 for additional detail on the circuitous water flow paths 100.

Figure 24:
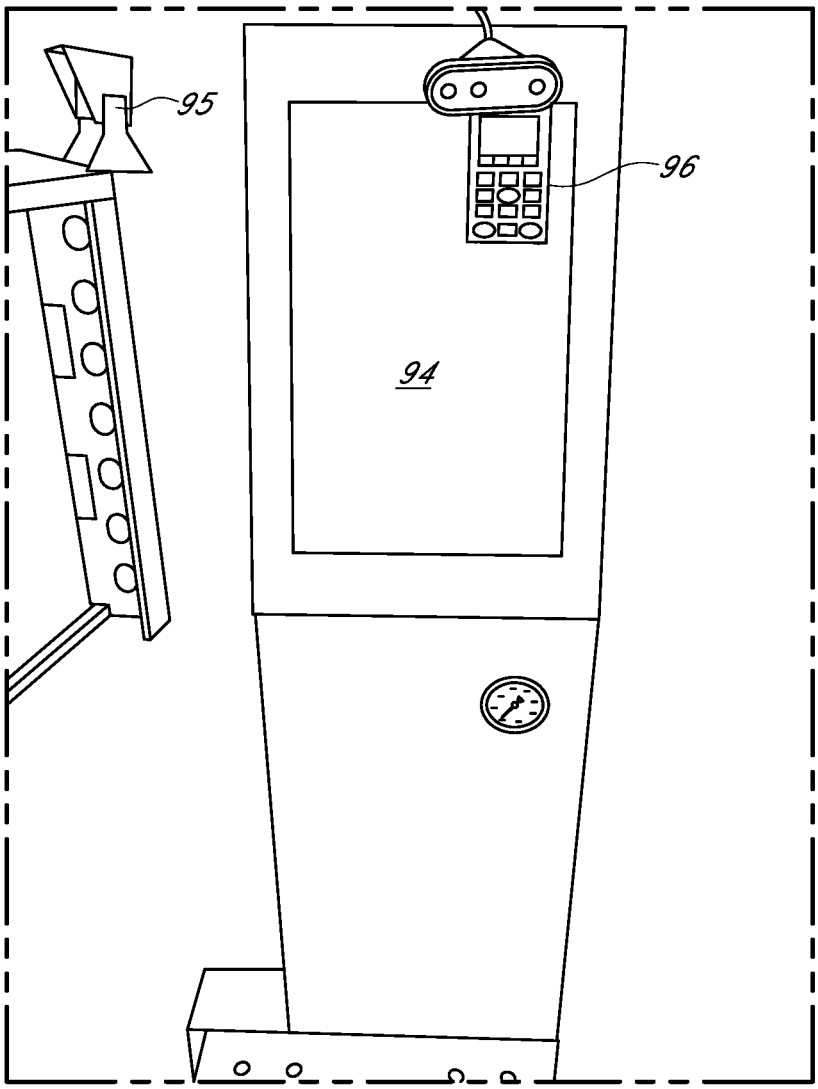
FIG. 24 is a perspective view of the pumping/control unit for the Safe Treadmill Swimming Pool. As disclosed, the unit may be configured with an electric motor with a variable frequency drive allowing full speed control for an enhanced user experience. The speed of the external motor is controlled by a variable frequency device (VFD). Accordingly, the amount of electrical energy used by the external motor is proportional to the speed of the propulsion system. To increase the speed of the propulsion system, the speed of the electric motor is increased using the VFD. As disclosed the VFD is mounted adjacent the external motor and the VFD may be controlled remotely by the user.
Figure 26:
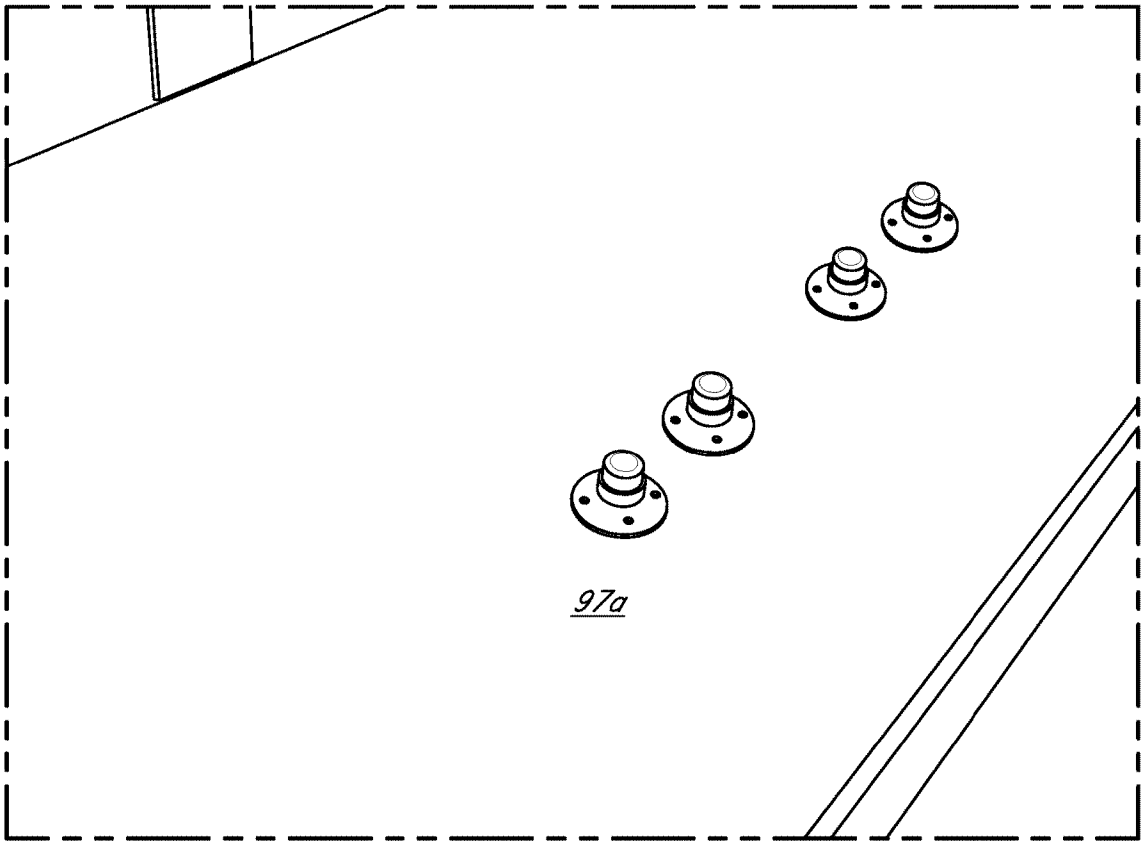
FIG. 26 is a perspective view of the hydraulic manifold for coupling to the hydraulic drives of the pair of propellers.
Figure 29:
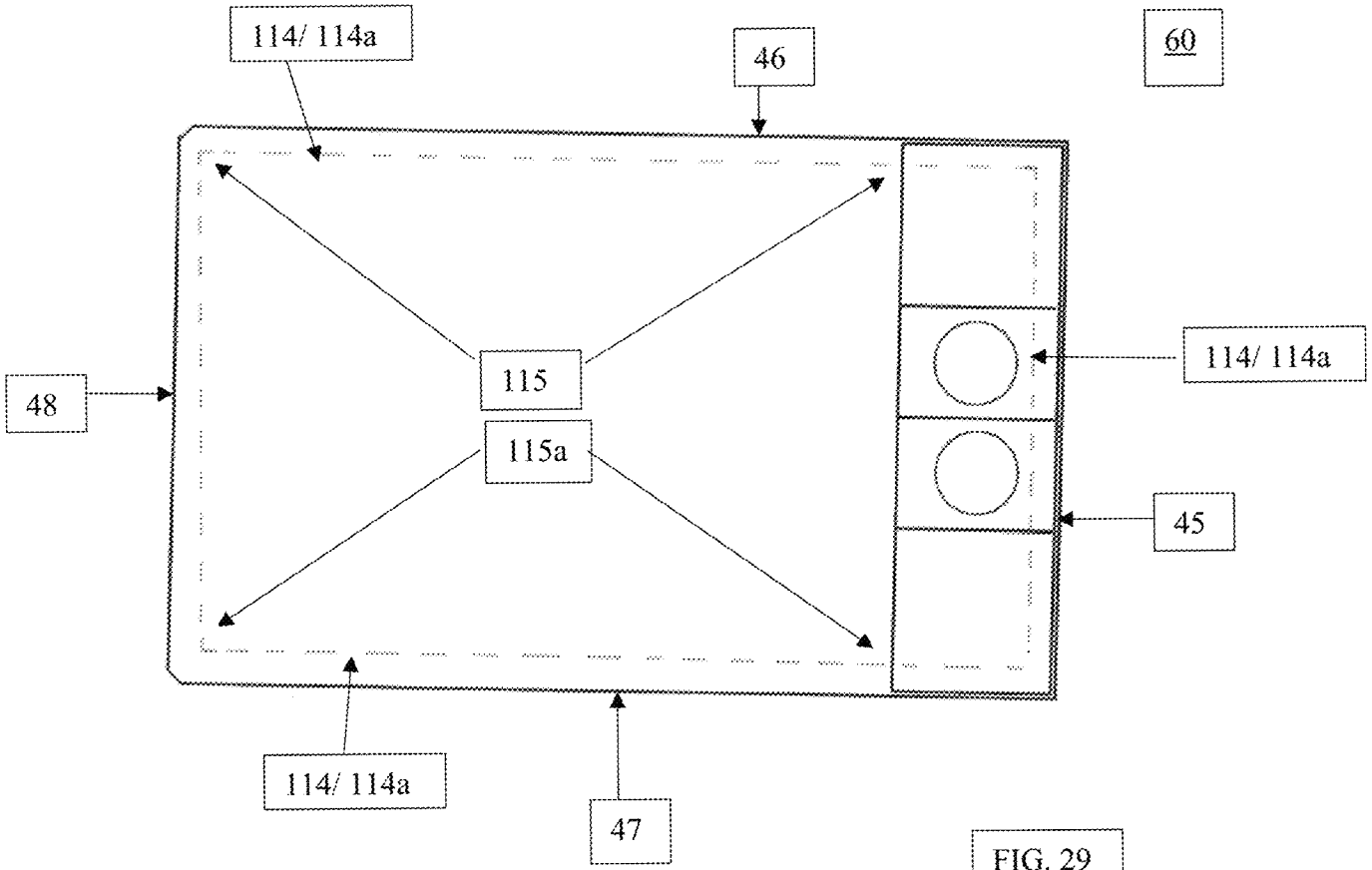
FIG. 29 is a simplified illustrative top view of an exercise pool and pool floor constructed according to FIGS. 28 and 28A.

As disclosed and discussed in FIGS. 1, 24 and 26, a self-contained hydraulic system 5 positioned exterior of the self-contained drop-in propulsion unit 70 is coupled or connected to the pair of propellers 87 to drive the pair of propellers 87 for discharge of the water flow path 100*a* into the inner water containment area 2 located anterior of the self-contained drop-in propulsion unit 70, the inner water containment area 2 defined by the second sidewall 46, the third sidewall 47 and the fourth sidewall 48 of the exercise pool 60. As shown in FIGS. 18, 19 and 29, the inner water containment area 2 has an absence of a separate return flow structure 3 to aid in delivery of the circulating water flow to the pair of propellers 87 via the plurality of inlets 81 in the plenum arrangement 80 of the self-contained drop-in propulsion unit 70.

Figure 23:
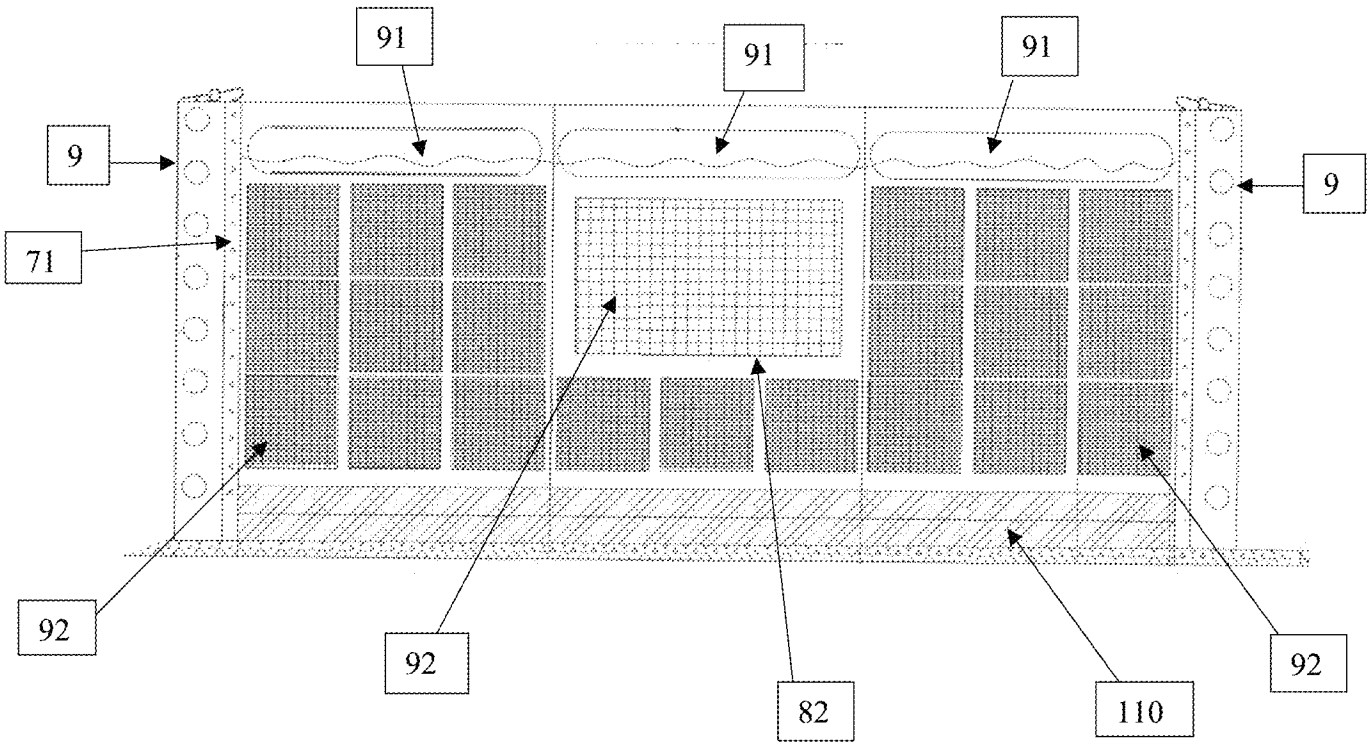
FIG. 23 is an illustrative front view of another embodiment of the self-contained propulsion unit as positioned in combination with the modular wall structure of FIG. 18.

FIG. 23 is an illustrative front view of another embodiment of the self-contained propulsion unit 70 as positioned in combination with the modular wall structure of FIG. 18. As shown the self-contained propulsion unit 70 and plenum arrangement 80 are configured with at least one air slot 91 is positioned in the front side 71 of the plenum arrangement of the self-contained drop-in propulsion unit, the at least one air slot 91 is positioned above both the common outlet 82 and the plurality of water inlets 81 to limit the height (level) of the circulating water present in the interior of the self-contained drop-in propulsion unit and maintain an air gap above the circulating water flow, called out or defined as the "water level" 99. See FIGS. 20, 21 and 23. One of ordinary skill will appreciate that air gap 98 should be positioned above the plurality of water inlets in front side 71 and may have any shape acceptable and suitable to allow for maintaining an air gap 28 during operating of the propulsion system 70. As shown in FIG. 23, three air slots 91 are positioned across the top of the front side of the self-contained drop-in unit 70, each air slot of similar size and having a lower dimension in the range of six (6.0) inches from the top to produce a corresponding air gap of six (6.0) inches. As shown in FIGS. 19, 20 and 23, the common outlet 82 is typically positioned in the front side of the plenum arrangement 71 and is generally centered between the left end and the right end of the self-contained drop-in propulsion unit (75, 76). FIG. 24 is a perspective view of the pumping unit control 94 for the Exercise Pool 60. As disclosed, the pumping unit may be configured with an electric motor (not shown) with a variable frequency drive (VFD) (not shown) allowing full speed control for an enhanced user experience. The speed of the external electric motor (not shown) is controlled by a variable frequency device (VFD). Accordingly, the amount of electrical energy used by the external motor is proportional to the speed of the propulsion system. To increase the speed of the propulsion system, the speed of the electric motor is increased using the VFD. As disclosed the VFD is mounted adjacent the external electric motor and the VFD may be controlled via a remote 96 by the user.

Figure 25:
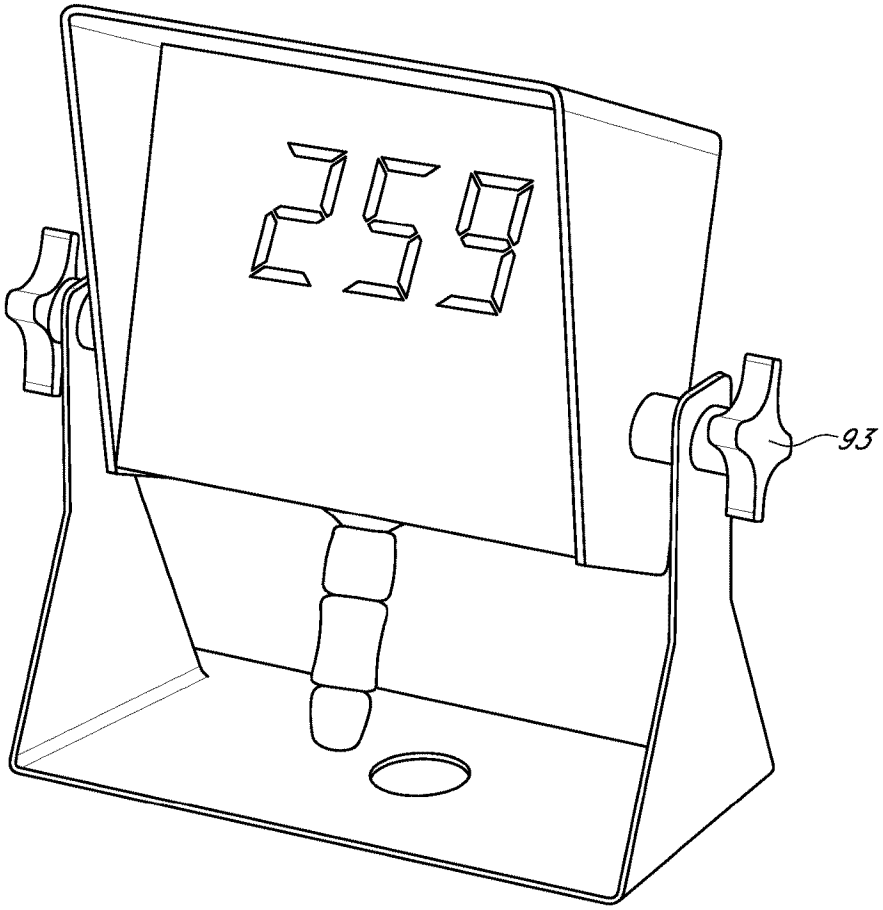
FIG. 25 is a speed indicator for the pool and is electrically connected to the electric drive motor and VFD which are externally positioned to drive the hydraulic system.

FIG. 25 is a speed indicator 93 for the circulating water in the exercise pool and is electrically connected to the electric drive motor and VFD which are externally positioned to drive the hydraulic system 5. FIG. 26 is a perspective view of the hydraulic manifold 97*a* for coupling to the hydraulic drives of the pair of propellers 87. FIG. 27 is a perspective view of the hydraulic fluid pumping system manifold 97*b* of the plenum arrangement 80 and the hydraulic fluid cooler 97*b* which may be positioned therein.

Figure 28A:
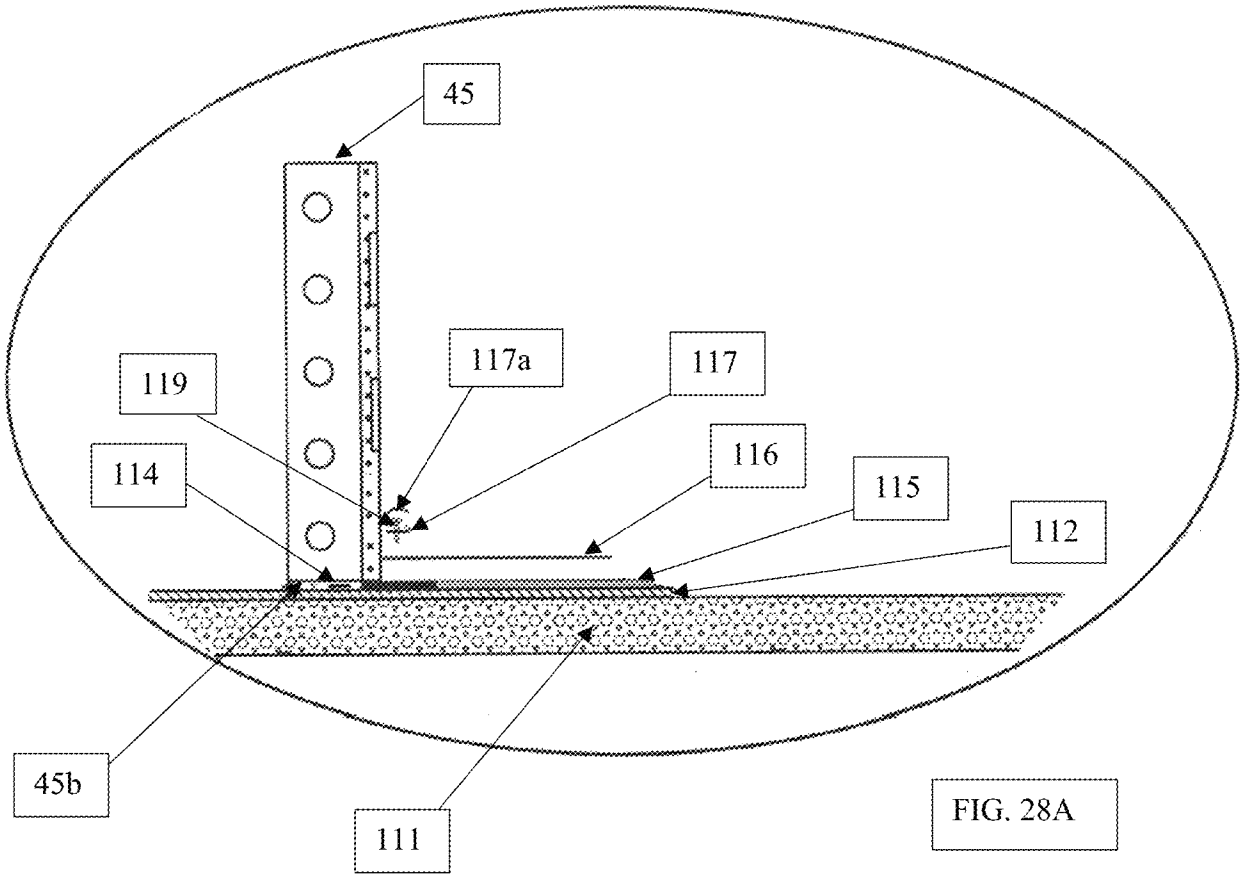
FIG. 28A is a detailed view of the first, second and third layers of construction materials disclosed herein.

FIG. 28 is a perspective view of pool floor 110 fabrication method and structure useful in reducing construction time and improving outcomes herein. The exercise pool 60 with a circulating water flow may be constructed with a pool floor 110 positioned below and connected to the bottom of the first sidewall 45, the second sidewall 46, the third sidewall 47 and the fourth sidewall 48, wherein the exercise pool floor 110 is generally non-sloped and further comprises a first layer of self-leveling concrete 112 applied to an existing level floor 111 and is at least the equivalent area as the area 58 occupied by an exterior perimeter 56 formed by the first sidewall 45, the second sidewall 46, the third sidewall 47 and the fourth sidewall 48. A second layer 113 is then positioned upon the first layer of self-leveling concrete 112, the second layer 113 being composed of an outer area of rigid PVC 114 and an inner area of rigid insulation 115 (pink board), the outer area of rigid PVC 114*a* having an outer perimeter 114*b* and surrounding the inner area of rigid foam board 115*a*, wherein the bottom side of the first sidewall 45*b* (shown in FIG. 28 and FIG. 28A), the second sidewall 46*b* (not shown), the third sidewall 46*b* (not shown) and the fourth sidewall 47*b* (not shown) rest directly upon the outer perimeter of rigid PVC 114*b*. A third layer 116 composed of a vinyl liner between 50 and 80 mils (mm) thick is positioned upon the second layer 113, the third layer 116 sized to cover the second layer 113 enclosed by the area 59 of the interior perimeter 57 of the first sidewall 45, the second sidewall 46, the third sidewall 47 and the fourth sidewall 48. The position of the second layer 113 and the third layer 116 are fixed in relation to the first sidewall 45, the second sidewall 46, the third sidewall 47 and the fourth sidewall 48 via a compression strip 117 attached via a plurality of floor fasteners 119 affixed into and through the compression strip 117, the third layer 116, the second layer 113 and the first layer 112, the compression strip 117 positioned around an interior perimeter 57 formed by first sidewall 45, the second sidewall 46, the third sidewall 47 and the fourth sidewall 48. FIG. 28A is a detailed view of the first layer 112, second layer 113 and third layers 116 of construction materials disclosed herein. One of ordinary skill will appreciate that compression strip 117 is configured and shown with a removable cover 117*a*. FIG. 29 is a simplified illustrative top view of an exercise pool 60 and pool floor 110 constructed according to FIGS. 28 and 28A.

The following modifications, although not shown, would be obvious to one of ordinary skill in the art in view of the present disclosure. The various elements of the Exercise Pool may be separately formed and later engaged with one another (e.g., via mechanical fasteners, material fusing, chemical adhesives, etc.) or integrally formed with one another. The materials used to construct the Exercise Pool and various elements thereof will vary depending on the specific application of the Exercise Pool, but it is contemplated that steel, aluminum, polymers, other synthetic materials, natural materials, and/or combinations thereof will be especially useful for some applications. Accordingly, the above-referenced elements may be constructed of any material known to those skilled in the art or later developed, which material is appropriate for the specific application of the Exercise Pool, without departing from the spirit and scope of the Exercise Pool as disclosed and claimed herein.

Having described the preferred embodiments, other features of the Exercise Pool will undoubtedly occur to those versed in the art, as will numerous modifications and alterations in the embodiments as illustrated herein, all of which may be achieved without departing from the spirit and scope of the Exercise Pool disclosed herein. Accordingly, the methods and embodiments pictured and described herein are for illustrative purposes only, and the scope of the present disclosure extends to all method and/or structures for providing increased functionality, comfort, longevity, enjoyment and aesthetics in the use and access of a Exercise Pool. Furthermore, the methods and embodiments pictured and described herein are no way limiting to the scope of the Exercise Pool and method of use unless so stated in the following claims.

It should be noted that the Exercise Pool is not limited to the specific embodiments pictured and described herein, but is intended to apply to all similar apparatuses and methods for providing the various benefits and/or features of a Safe Treadmill Swimming Pool. Modifications and alterations from the described embodiments will occur to those skilled in the art without departure from the spirit and scope of the Safe Treadmill Swimming Pool. It is understood that the Exercise Pool as disclosed herein extends to all alternative combinations of one or more of the individual features mentioned, evident from the text and/or drawings, and/or inherently disclosed. All of these different combinations constitute various alternative aspects of the Exercise Pool and/or components thereof. The embodiments described herein explain the best modes known for practicing the Exercise Pool and/or components thereof and will enable others skilled in the art to utilize the same. The claims are to be construed to include alternative embodiments to the extent permitted by the prior art.

While the Exercise Pool has been described in connection with preferred embodiments and specific examples, it is not intended that the scope be limited to the particular embodiments set forth, as the embodiments herein are intended in all respects to be illustrative rather than restrictive.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including but not limited to: matters of logic with respect to arrangement of steps or operational flow; plain meaning derived from grammatical organization or punctuation; the number or type of embodiments described in the specification.

It will be apparent to those skilled in the art that various modifications and variations can be made without departing from the scope or spirit. Other embodiments will be apparent to those skilled in the art from consideration of the specification and practice disclosed herein. It is intended that the specification and examples be considered as illustrative only, with a true scope and spirit being indicated by the following claims.

The invention claimed is:

1. An exercise pool with a circulating water flow, comprising:

a) an exercise pool having a first wall, a second wall, a third wall and a fourth wall, each wall generally non-curved and having a first end and a second end, the first end of the first wall and the first end of the second wall forming a first corner of the exercise pool, the second end of the first wall and the first end of the third wall forming a second corner of the exercise pool, the first and second corners forming the head end of the exercise pool, the second end of the second wall and the first end of the fourth wall forming a third corner of the exercise pool, the second end of the third wall and the second end of the fourth wall forming a fourth corner of the exercise pool, the third and fourth corners forming the foot end of the exercise pool;

b) an exercise pool floor positioned below and connected to the bottom of the first wall, the second wall, the third wall and the fourth wall, wherein the exercise pool floor is generally non-sloped;

c) a self-contained drop-in propulsion unit, the self-contained drop-in propulsion unit to be positioned on the exercise pool floor between the first and second corners of the exercise pool, defined as the head end, the self-contained drop-in propulsion unit having a front side, a back side, a top side, a left end, a right end and a bottom side enclosing an interior, wherein the bottom side is configured to rest on the exercise pool floor, wherein the back side is configured to be positioned against the first wall, wherein a plenum arrangement is positioned therein, the plenum arrangement further comprising:

i. a pair of propellers positioned in the interior of the plenum arrangement, the pair of propellers positioned adjacent each other and in a common horizontal plane, each propeller of the pair of propellers configured for rotation towards the adjacent propeller in the horizontal plane;

ii. a plurality of water inlets positioned in the front side of the plenum arrangement to allow a circulating water flow to enter the interior of the self-contained drop-in propulsion unit for communication with the pair of propellers;

iii. an equalization wall positioned in the plenum arrangement, the equalization wall positioned between the plurality of water inlets and the pair of propellers, the equalization wall configured to balance the quantity of the circulating water flow to and between the pair of propellers;

iv. a set of curved vanes located in the interior of the plenum arrangement and positioned above the pair of propellers, the set of curved vanes configured to engage with and turn the circulating water flow from the pair of propellers in a generally vertical direction to a generally horizontal direction;

v. a common outlet positioned in the front side of the self-contained drop-in propulsion unit and in fluid communication with the set of curved vanes, the common outlet configured to allow discharge of the circulating water flow from the plenum arrangement of the self-contained drop-in propulsion unit wherein the circulating water flow forms a pair of circuitous water flow paths in the exercise pool, a first water flow path flowing from the head end to the foot end of the exercise pool, the first water flow path useful for swimming, and a second water flow path from the foot end to the head end of the exercise pool for recirculation through the plenum arrangement by the pair of propellers via the plurality of water inlets in the front side of the self-contained drop-in propulsion unit;

d) a self-contained hydraulic system positioned exterior of the self-contained drop-in propulsion unit and connected to the pair of propellers to drive the pair of propellers; and e) an inner water containment area located anterior of the self-contained drop-in propulsion unit and further defined by the second wall, the third wall and the fourth wall of the exercise pool, wherein the inner water containment area has an absence of a separate return flow structure to aid in delivery of the circulating water flow to the pair of propellers via the plurality of inlets in the plenum arrangement of the self-contained drop-in propulsion unit.

2. The exercise pool with a circulating water flow according to claim 1 wherein at least one air slot is positioned in the front side of the plenum arrangement of the self-contained drop-in propulsion unit, the at least one air slot positioned above both the common outlet and the plurality of water inlets to limit the height of the circulating water present in the interior of the self-contained drop-in propulsion unit and maintain an air gap above the circulating water flow.

3. The exercise pool with a circulating water flow according to claim 1 wherein the common outlet is positioned in the front side of the plenum arrangement and generally centered between the left end and the right end of the self-contained drop-in propulsion unit.

4. The exercise pool with a circulating water flow according to claim 1 wherein the common outlet, the pair of propellers and the set of curved vanes are positioned in the front side of the plenum arrangement and generally centered between the left end and the right end of the self-contained drop-in propulsion unit.

5. The exercise pool with a circulating water flow according to claim 1 wherein the fourth wall of the exercise pool has an absence of a curved vane to aid in delivery of the circulating water flow back to the pair of propellers via the plurality of inlets for recirculation and pressurization of the circulating water flow.

6. The exercise pool with a circulating water flow according to claim 1 wherein the fourth wall of the exercise pool has an absence of any flow bending structure to aid in delivery of the circulating water flow back to the pair of propellers via the plurality of inlets for recirculation and pressurization of the circulating water flow.

7. The exercise pool with a circulating water flow according to claim 1 wherein the top side of the self-contained drop-in propulsion unit is removable.

8. The exercise pool with a circulating water flow according to claim 1 wherein the top side of the self-contained drop-in propulsion unit is configured as a walkway.

9. The exercise pool with a circulating water flow according to claim 1 wherein the walls are built from a plurality of modular pieces.

10. The exercise pool with a circulating water flow according to claim 1 wherein the equalization wall is positioned below the pair of propellers positioned in the interior of the self-contained drop-in propulsion unit and extends from the front side to the back side of the plenum arrangement.

11. The exercise pool with a circulating water flow according to claim 1 wherein the common outlet is configured as a grate.

12. The exercise pool with a circulating water flow according to claim 1 wherein the plurality of water inlets is configured as grating.

13. The exercise pool with a circulating water flow according to claim 1 wherein the circulating water flow forms a pair of circuitous water flow paths in the exercise pool, a first water flow path flowing from the head end to the foot end of the exercise pool and generally in the center of the pool, the first water flow path useful for swimming, and a second water flow path flowing from the foot end to the head end of the exercise pool and generally along the second and the third sides of the pool for recirculation by the pair of propellers via the plurality of water inlets.

14. The exercise pool with a circulating water flow according to claim 1 wherein each propeller of the pair of propellers is powered by a hydraulic motor which is coupled to the self-contained hydraulic system positioned exterior of the self-contained drop-in propulsion unit to drive the pair of propellers.

15. The exercise pool with a circulating water flow according to claim 1 wherein the exercise pool floor positioned below and connected to the bottom of the first wall, the second wall, the third wall and the fourth wall, wherein the exercise pool floor is generally non-sloped and further comprises:

a) a first layer of self-leveling concrete applied to an existing level floor and is of an equivalent area as the area occupied by an exterior perimeter formed by the first wall, the second wall, the third wall and the fourth wall;

b) a second layer positioned upon the first layer of self-leveling concrete, the second layer composed of an outer area of pvc and an inner area of rigid foam board, the outer area of pvc having an outer perimeter and surrounding the inner area of rigid foam board, wherein the bottom side of the first wall, the second wall, the third wall and the fourth wall rest directly upon the outer perimeter of rigid pvc;

c) a third layer composed of vinyl positioned upon the second layer, the third layer sized to cover the second layer enclosed by the interior of the first wall, the second wall, the third wall and the fourth wall;

d) wherein the position of the second layer and the third layer are fixed in relation to the first wall, the second wall, the third wall and the fourth wall via a compression strip attached via a plurality of fasteners affixed into and through the compression strip, the third layer, the second layer and the first layer, the compression strip positioned around an interior perimeter formed by the first wall, the second wall, the third wall and the fourth wall.

16. The exercise pool with a circulating water flow according to claim 1 wherein the drop-in propulsion unit is configured so that the pool floor is the bottom side of the drop-in propulsion unit.

17. A self-contained drop-in propulsion unit for use with a pool to create an exercise pool, the self-contained drop-in propulsion unit comprising:

a) a plenum arrangement enclosing an interior as defined by a front side, a back side, a top side, a left end, a right end and a bottom side of the self-contained drop-in propulsion unit;

b) a pair of propellers positioned in the interior of the self-contained drop-in propulsion unit, the pair of propellers positioned adjacent each other and in a common horizontal plane, each propeller of the pair of propellers configured for rotation towards the adjacent propeller in the horizontal plane;

c) a plurality of water inlets positioned in the front side of the plenum arrangement to allow a circulating water flow to enter the interior of the self-contained drop-in propulsion unit for communication with the pair of propellers;

d) an equalization wall positioned in the interior of the self-contained drop-in propulsion unit, the equalization wall positioned between the plurality of water inlets and the pair of propellers, the equalization wall configured to balance the quantity of the circulating water flow to and between the pair of propellers;

e) a set of curved vanes located in the interior of the self-contained drop-in propulsion unit and positioned above the pair of propellers, the set of curved vanes configured to engage with and turn the circulating water flow from the pair of propellers in a generally vertical direction to a generally horizontal direction;

f) a common outlet positioned in the front side of the plenum arrangement and in fluid communication with the set of curved vanes, the common outlet configured to allow discharge of the circulating water flow from the self-contained drop-in propulsion unit wherein the circulating water flow forms a pair of circuitous water flow paths in the exercise pool, a first water flow path flowing from the head end to the foot end of the exercise pool, the first water flow path useful for swimming, and a second water flow path from the foot end to the head end of the exercise pool for recirculation by the pair of propellers via the plurality of water inlets;

g) a self-contained hydraulic system positioned exterior of the self-contained drop-in propulsion unit and connected to the pair of propellers to drive the pair of propellers, wherein the self-contained drop-in propulsion unit may be positioned in a pool with an inner water containment area located anterior of the self-contained drop-in propulsion unit, wherein the inner water containment area has an absence of a separate return flow structure to aid in delivery of the circulating water flow to the pair of propellers via the plurality of inlets thereby allowing conversion of the pool into an exercise pool.

18. A self-contained drop-in propulsion unit for use with a pool to create an exercise pool according to claim 17, wherein each propeller of the pair of propellers is powered by a hydraulic motor which is coupled to the self-contained hydraulic system positioned exterior of the self-contained drop-in propulsion unit to drive the pair of propellers.

19. A self-contained exercise pool for containment of water and generation of water currents therein comprising:

a) a rigid frame exteriorly located and surrounding an inner water containment area having a first, a second, a third and a fourth side wherein the rigid frame further comprising:

i. a plurality of pool panels having a first and second side, the first side having a relatively smooth surface and positioned to face the inner water containment area;

ii. a plurality of vertically orientated wall and deck supports positioned around the perimeter of the inner water containment area and wherein the second side of the plurality of pool panels attaches to the plurality of wall and deck supports;

iii. a plurality of horizontally orientated wall supports having a first and second side connected to and between the plurality of vertically orientated wall and deck supports and wherein the first side of the plurality of horizontally orientated wall supports faces the second side of plurality of the pool panels;

iv. a plurality of tension straps attached to the first, second, third and fourth sides, wherein a pre-determined number of the tension straps are positioned to connect the first side to the third side of the inner water containment area and a pre-determined number of the tension straps are positioned to connect the second side to the fourth side of the inner water containment area;

v. a plurality of wall seam connecting plates positioned at the upper exterior portion of the wall and deck supports for attachment of adjacent the plurality of wall and deck supports; and vi. a plurality of adjustable screw plates positioned at the lower exterior portion of the wall and deck supports for attachment of adjacent the plurality of wall and deck supports;

vii. an exercise pool floor positioned below and connected to the bottom of the first wall, the second wall, the third wall and the fourth wall, wherein the exercise pool floor is generally non-sloped;

b) a self-contained drop-in propulsion unit, the self-contained drop-in propulsion unit to be positioned on the pool floor between the first and second corners of the exercise pool, defined as the head end, the self-contained drop-in propulsion unit further comprising:

i. a plenum arrangement enclosing an interior as defined by a front side, a back side, a top side, a left end, a right end and a bottom side of the self-contained drop-in propulsion unit;

ii. a pair of propellers positioned in the interior of the self-contained drop-in propulsion unit, the pair of propellers positioned adjacent each other and in a common horizontal plane, each propeller of the pair of propellers configured for rotation towards the adjacent propeller in the horizontal plane;

iii. a plurality of water inlets positioned in the front side of the plenum arrangement to allow a circulating water flow to enter the interior of the self-contained drop-in propulsion unit for communication with the pair of propellers;

iv. an equalization wall positioned in the interior of the self-contained drop-in propulsion unit, the equalization wall positioned between the plurality of water inlets and the pair of propellers, the equalization wall configured to balance the quantity of the circulating water flow to and between the pair of propellers;

v. a set of curved vanes located in the interior of the self-contained drop-in propulsion unit and positioned above the pair of propellers, the set of curved vanes configured to engage with and turn the circulating water flow from the pair of propellers in a generally vertical direction to a generally horizontal direction;

vi. a common outlet positioned in the front side of the plenum arrangement and in fluid communication with the set of curved vanes, the common outlet configured to allow discharge of the circulating water flow from the self-contained drop-in propulsion unit wherein the circulating water flow forms a pair of circuitous water flow paths in the exercise pool, a first water flow path flowing from the head end to the foot end of the exercise pool, the first water flow path useful for swimming, and a second water flow path from the foot end to the head end of the exercise pool for recirculation by the pair of propellers via the plurality of water inlets; and, c) a power system for driving the pair of propellers to produce a current in the inner water containment area and wherein the power system is self-contained and mounted external of the rigid frame.

20. The self-contained swimming pool for containment of water and generation of water currents therein according to claim 19 wherein the water produces outward forces that when placed upon the tension strap ends lock the tension straps ends against the openings in the lower portion of the plurality of the wall and deck supports.

21. The self-contained swimming pool for containment of water and generation of water currents therein according to claim 19 wherein the plurality of tension straps are horizontally orientated and each the tension strap has a first end and a second end, the first end and the second end each having a vertical portion therein for insertion into a vertical opening in the lower portion of the wall and deck supports wherein the vertical portion of the tension strap is perpendicular with the wall and deck support.

22. The self-contained swimming pool as set forth in claim 19 wherein a decorative horizontal surface is positioned upon the rigid frame to surround the inner water containment area.

23. The self-contained swimming pool as set forth in claim 19 wherein the rigid frame is composed of modular interlocking panels.

24. The self-contained swimming pool as set forth in claim 23 wherein the modular interlocking panels are opposedly positioned for increased structural rigidity.

25. The self-contained swimming pool as set forth in claim 24 wherein the modular interlocking panels are connected by tension straps to further improve structural rigidity.

26. A self-contained swimming pool for containment of water and generation of water currents therein comprising:

a) a rigid frame exteriorly positioned around the perimeter of an inner water containment area—the rigid frame further comprising:

i. at least one modular interlocking panel having a first and a second end;

ii. at least one pair of vertical wall supports, wherein each said first end and each said second end of said at least one modular interlocking panel is connected to least one vertical wall support of said at least one pair of wall vertical supports; and, iii. at least one horizontal wall support positioned on the exterior of said rigid frame adjacent said at least one modular interlocking panel and connected between said at least one pair of adjacent vertical wall supports;

b) a propulsion system in communication with and configured to circulate water in the inner water containment area without a set of separate water return channels; and, c) a hydraulic system for driving the propulsion system using a hydraulic fluid to produce a current in the inner water containment area and wherein the hydraulic system is self-contained and mounted external of the rigid frame.

27. The self-contained swimming pool according to claim 26 wherein a decorative horizontal surface is positioned upon the rigid frame to surround the inner water containment area.

28. The self-contained swimming pool as set forth in claim 26 wherein the modular interlocking panels are opposedly positioned for increased structural rigidity.

* * * * *